US008256164B2

(12) United States Patent
Cuccurullo

(10) Patent No.: US 8,256,164 B2
(45) Date of Patent: Sep. 4, 2012

(54) SAFETY HATCH HAVING RAIL MOUNTING SYSTEM

(76) Inventor: Joseph Cuccurullo, Houston, TX (US)

( * ) Notice: Subject to any disclaimer, the term of this patent is extended or adjusted under 35 U.S.C. 154(b) by 361 days.

(21) Appl. No.: 12/459,048

(22) Filed: Oct. 8, 2009

(65) Prior Publication Data

US 2011/0083376 A1 Apr. 14, 2011

(51) Int. Cl.
*E02D 29/14* (2006.01)
*E04B 7/18* (2006.01)
*E04H 17/00* (2006.01)

(52) U.S. Cl. ..... 52/20; 52/19; 52/200; 256/65.02

(58) Field of Classification Search ..... 52/19, 20, 52/21, 106, 107, 200, 655.1; 256/59, 65.02, 256/73

See application file for complete search history.

(56) References Cited

U.S. PATENT DOCUMENTS 6,272,800 B1 * 8/2001 Phinney et al. ..... 52/200
6,467,230 B1 * 10/2002 Perkins et al. ..... 52/655.1
6,477,972 B2 * 11/2002 Perkins ..... 114/201 R
6,681,528 B1 * 1/2004 Profeta et al. ..... 52/20
6,688,046 B2 * 2/2004 Perkins ..... 52/19
6,931,793 B2 * 8/2005 Joyce et al. ..... 52/20
7,516,575 B2 * 4/2009 Cuccurullo ..... 52/20
2003/0209207 A1 * 11/2003 Campbell et al. ..... 119/513
2005/0006634 A1 * 1/2005 Cuccurullo ..... 256/1
2007/0228352 A1 * 10/2007 Higgs ..... 256/59
2010/0031455 A1 * 2/2010 Honeycutt et al. ..... 14/69.5
2010/0326769 A1 * 12/2010 Cuccurullo et al. ..... 182/97
2011/0232201 A1 * 9/2011 Cardwell ..... 52/20

* cited by examiner

*Primary Examiner* — Joshua J Michener
*Assistant Examiner* — Ryan Kwiecinski
(74) *Attorney, Agent, or Firm* — James L. Jackson

(57) ABSTRACT

A safety hatch and safety railing assembly in unitary form which incorporates the fabrication of a roof or deck scuttle with safety guard rails as required by the Occupation Safety Hazards Act (OSHA) around the roof or deck opening of a building. The safety hatch or safety hatch and safety railing assembly of the present invention preferably employs safety railing mounting bracket components that are welded to hatch flashing or to bracket hanger members and are designed to receive and provide for safe and efficient mounting of vertical posts and rails of a safety railing assembly around a roof or deck access opening. The safety hatch and safety railing assembly provides an improved base flashing that additionally functions to hold the roofing membrane to the scuttle curb. Lateral elongate safety members have one end connected to the hatch cover and another end connected to safety railing support posts and being moveable to personnel protecting position upon opening movement of the hatch cover and a collapsed position upon closing of the hatch cover.

11 Claims, 16 Drawing Sheets

SAFETY HATCH HAVING RAIL MOUNTING SYSTEM

BACKGROUND OF THE INVENTION

1. Field of the Invention

The present invention relates generally to a safety hatch or scuttle device manufactured with a safety guard rail as part of the scuttle frame and also relates to the roof membrane retainer base flashing structure to hold the roofing membrane to the curb of the safety hatch. This invention also concerns the provision of independent safety rail bracket support members that can be secured at any desired location along the upper rim of a safety hatch curb. More particularly the present invention concerns a safety hatch assembly having hatch curb flashing securing roofing membrane to the curb and providing for mounting of safety rail support brackets that support a safety rail assembly in position for efficient use. The present invention also concerns a safety hatch system incorporating a safety railing assembly that is operatively connected with the hatch door or closure and is raised from a collapsed condition to its safe position responsive to opening movement of the pivotally mounted hatch.

2. Description of the Related Art

A safety hatch is generally a rectangular metal frame of any size and shape with welded components designed to be secured to a roof or floor structure about an opening permitting personnel movement through the opening, such as for access of service personnel to the roof of a building. Conventional safety hatches have a vertical sheet metal inner curb wall surface liner flashing with a 90° horizontal flange at the bottom of the wall that extends beneath the curb and serves to anchor the curb to the roof or floor deck with fasteners that extend through holes provided in the flange. Rigid fiberboard insulation is typically provided around the inner wall and forms the outer wall of the frame of the curb. A sheet metal flashing caps the top of the liner wall and extends downward to cover the top portion of the outer wall. A pivotally mounted metal or plastic cover or closure is commonly used to cover the rectangular frame and is provided with a hinge on one end that is secured to the upper portion of the safety hatch frame. The cover has an inner and/or outer handle which is actuated to unlock, open or close and lock the cover. For ease of opening or closing the hatch cover or door one or more torsion bar springs are compressed during closing movement to cushion operation of the cover and prevent the cover from slamming closed by dead weight.

A typical safety hatch structure is presented in U.S. Pat. No. 6,672,020 of Cermola et al. A safety hatch mechanism having roofing membrane support is presented in U.S. Pat. Nos. 4,941,300 and 5,960,596 of Lyons. Safety hatchs having movable skylights are presented in U.S. Pat. No. 5,638,645 of Lipton. Safety rail and safety hatch or hatch assemblies are presented in U.S. Pat. No. 6,681,528 of Proveta et al and U.S. Patent Publication No. US 2005/0006634 of Joseph Cuccurullo.

SUMMARY OF THE INVENTION

It is a principal feature of the present invention to provide a novel safety hatch and safety railing unit having hatch or curb rim flashing and having safety rail mounting brackets fixed by by welding or any other suitable means to an exterior portion of the flashing.

It is another feature of the present invention to provide a novel safety hatch and safety railing unit having safety railing attachment posts each having a mounting member supported thereby and being adapted to be releasably secured to the safety rail mounting brackets.

It is also a feature of the present invention to provide a novel safety hatch and safety railing unit having safety rail mounting brackets that project perpendicularly from the curb rim flashing and other safety rail mounting brackets that project laterally and forwardly in angular relation with the curb rim flashing for location of a forward portion of a safety rail unit forwardly of the curb of the safety hatch.

It is another feature of the present invention to provide a novel safety hatch and safety railing unit having a plurality of safety rail support bracket assemblies being mounted to the curb of the safety hatch and each providing support for a safety rail support bracket welded or otherwise fixed thereto.

It is also a feature of the present invention to provide a novel safety hatch and safety railing unit having a forward safety rail structure designed for safe movement of personnel into and through the safety rail enclosure and minimizing the potential for personnel on a roof or deck to fall into the roof opening.

It is an even further another feature of the present invention to provide a novel safety hatch and safety railing assembly wherein components of the safety railing assembly are operatively connected to the hatch structure and cause movement of the safety railing assembly from a collapsed position to raised and operative position responsive to opening of the hatch closure.

Other and further objects and features of the present invention will become inherent upon an understanding of the safety hatch and safety railing unit presented by this disclosure, including the specification, drawings and appended claims.

Briefly, the present invention is a novel safety hatch and safety railing assembly in unitary form which incorporates the fabrication of a roof or floor scuttle with safety guard rails as required by the Occupation Safety Hazards Act (OSHA) around the roof opening of a building. The combined safety hatch and safety railing unit of the present invention preferably employs safety railing mounting bracket components that are welded in place and are designed to receive and provide for safe and efficient mounting of vertical posts and rails of a safety railing assembly around a roof or deck access opening.

The safety hatch and safety railing assembly of the present invention incorporates exterior safety hatch flashing that additionally serves to position and secure a portion of a roofing membrane between the flashing and the wall structure of the scuttle or curb.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an isometric illustration showing a safety hatch, also referred to as a safety hatch, being constructed according to the principles of the present invention;

FIG. 2 is an exploded illustration in plan view showing the safety hatch of the present invention with its hatch cover in the closed position and showing the preferred embodiment of the safety rail assembly for mounting to safety rail support brackets thereof;

FIG. 3 is an exploded illustration similar to that of FIG. 2 and showing an alternative embodiment of the safety rail assembly;

FIG. 4 is an exploded illustration similar to that of FIGS. 2 and 3 and showing a further alternative embodiment of the safety rail assembly;

FIG. 4A is an elevational view showing an alternative embodiment of the present invention employing a spring-energized self-closing gate member that is pivotally mounted to the front opening portion of the safety rail assembly;

FIG. 5 is a plan view showing the safety hatch of the present invention with its hatch cover closed and further showing four safety rail mounting brackets positioned for mounting the safety rail sections of FIGS. 2-5 in assembly with the safety hatch;

FIG. 5A is a plan view showing one of the safety rail mounting bracket designs in detail, the mounting bracket projecting in perpendicular relation with the side walls of the curb;

FIG. 5B is a plan view showing another of the safety rail mounting bracket designs in detail, the mounting bracket projecting in angular relation with the side walls of the curb and projecting beyond the plane of the front wall of the curb for location of the front portion of the safety rail assembly;

FIG. 6 is a partial sectional view of the safety hatch of the present invention showing the cap flashing and hatch cover and further showing a safety rail mounting bracket and a lower portion of a safety rail support fixed thereto and projecting upwardly therefrom;

FIG. 7 is a partial sectional view similar to the sectional view of FIG. 6 and showing apparatus for lateral positioning of the safety hatch cap flashing and hatch cover of the present invention;

FIG. 8 is a partial elevational view showing a safety rail mounting bracket and showing a safety rail support being mounted thereto;

Figure 8:
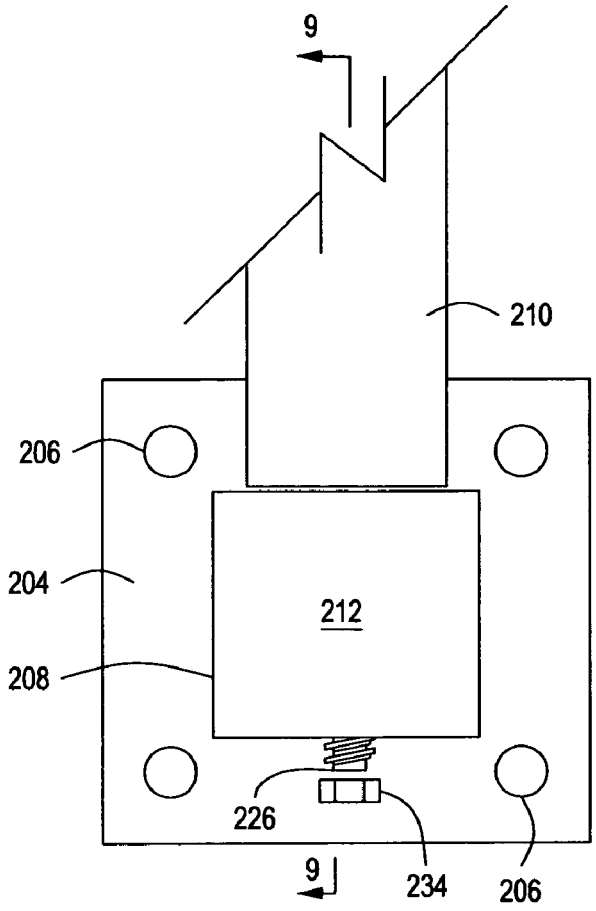
Figure 9:
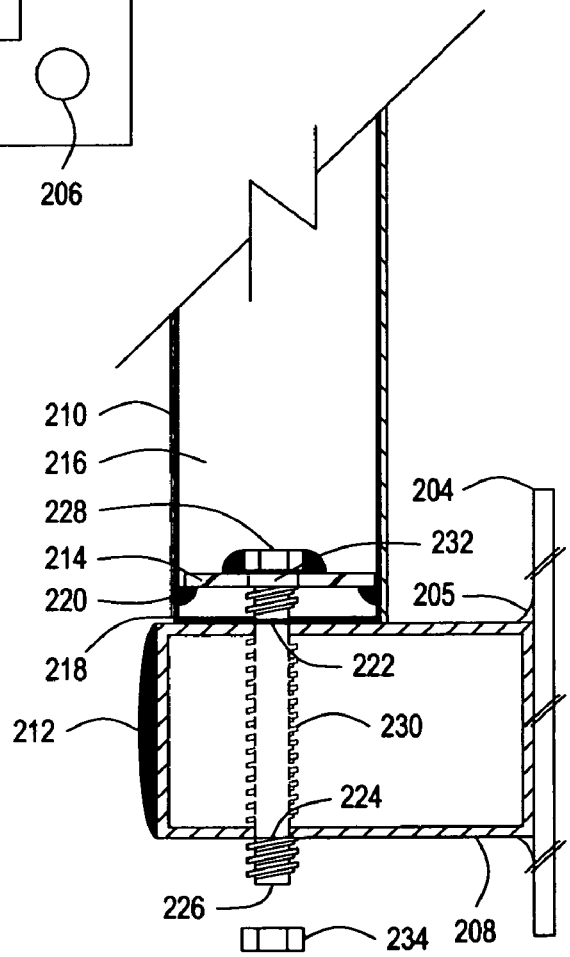
Figure 10:
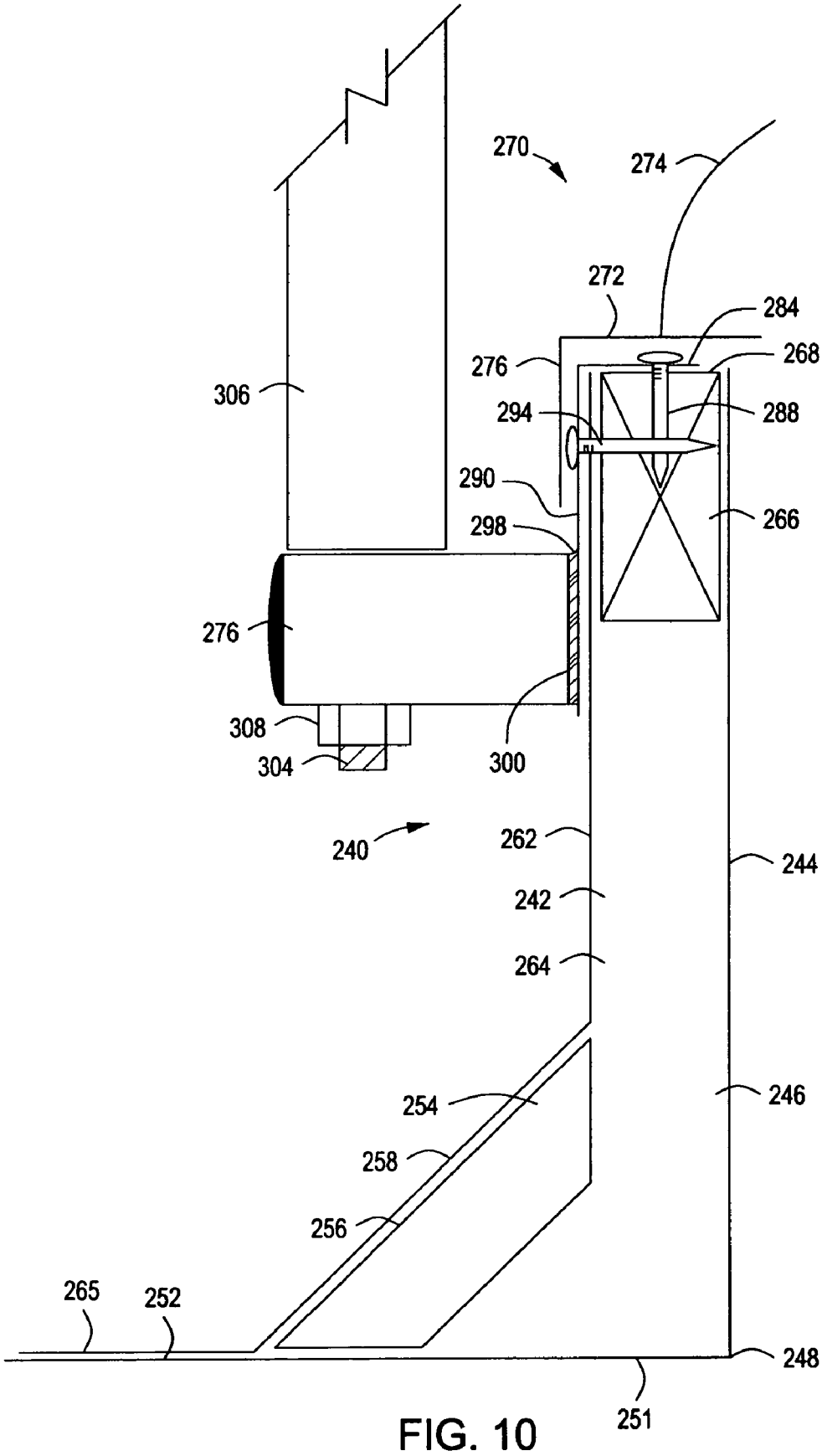
Figure 11:
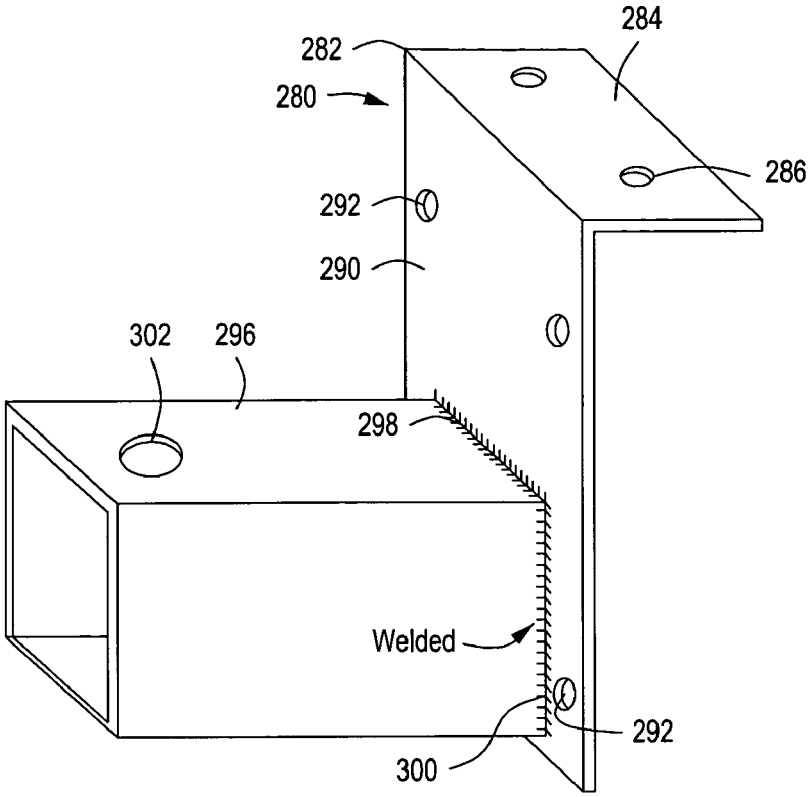
Figure 12:
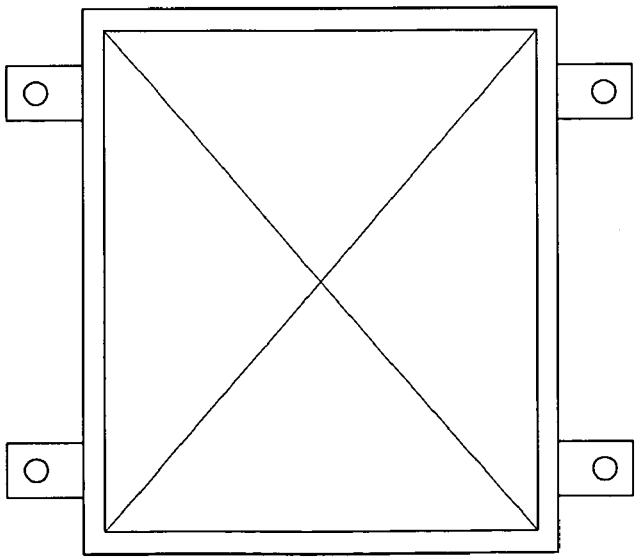
Figure 13:
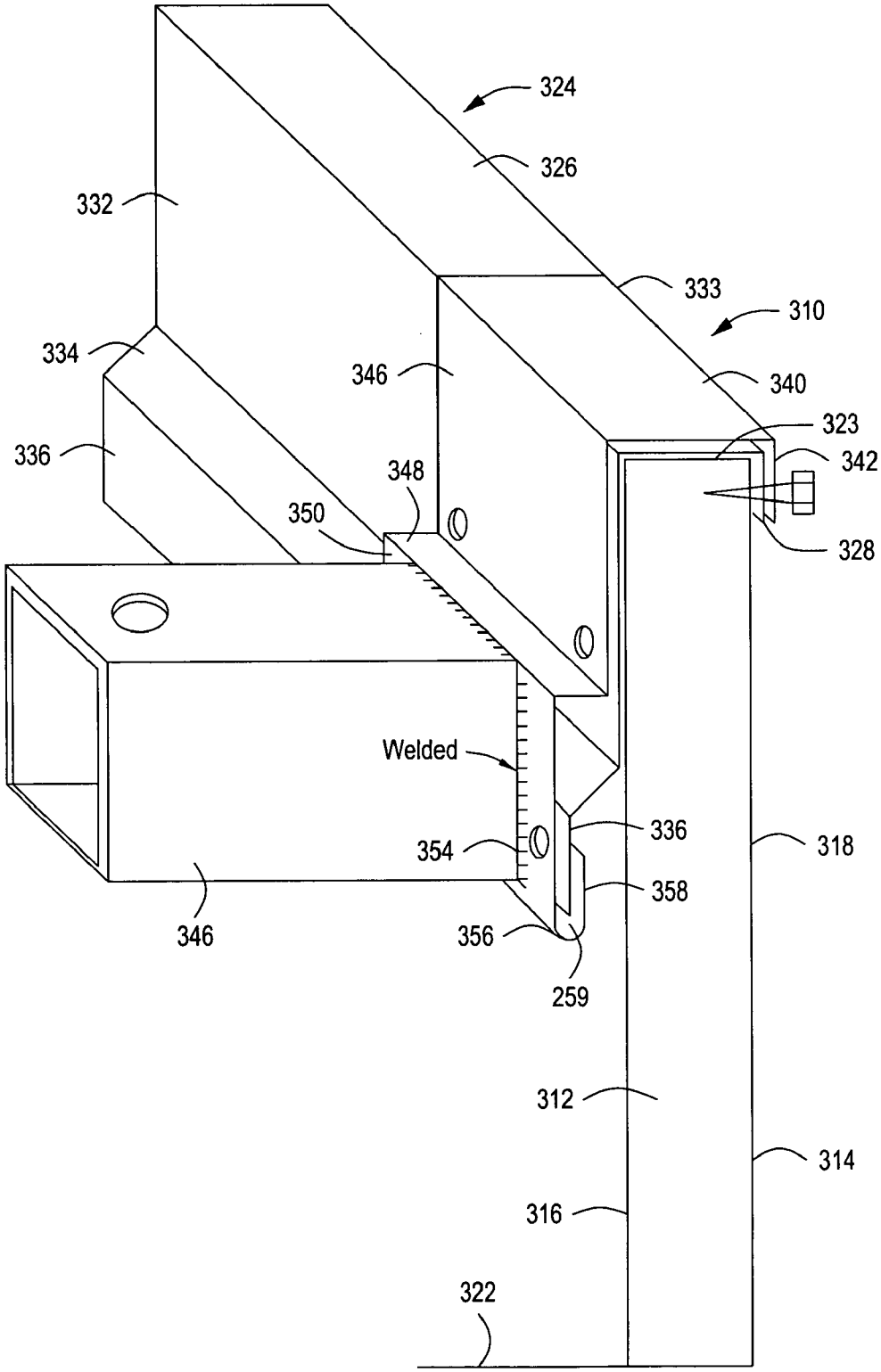
Figure 14:
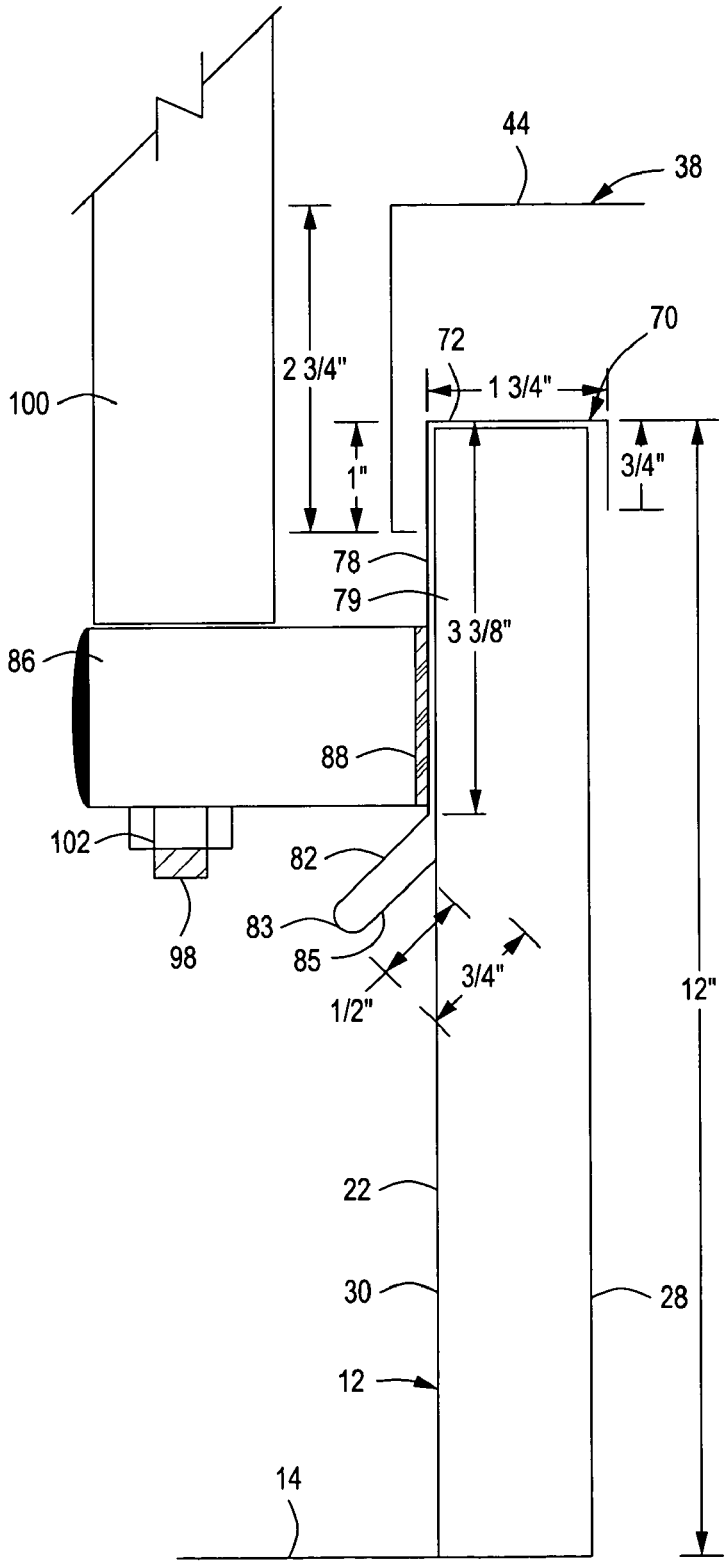
Figure 14A:
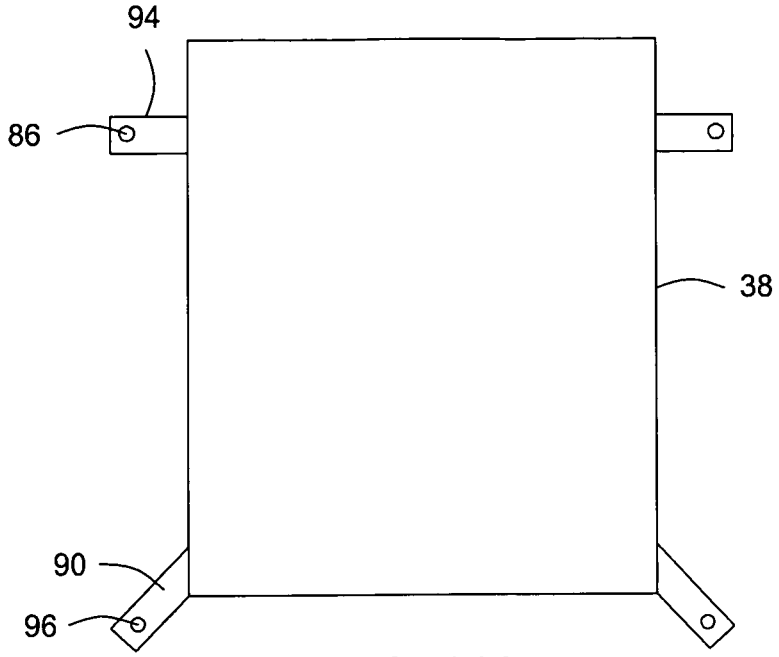
Figure 14B:
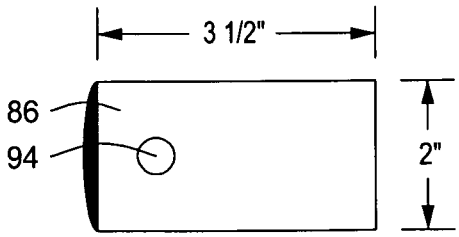
Figure 14C:
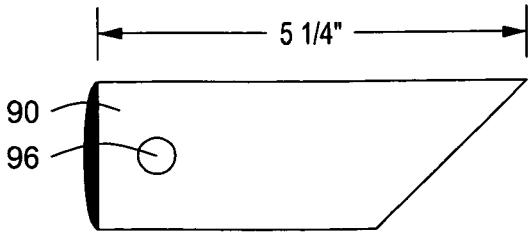
Figure 15:
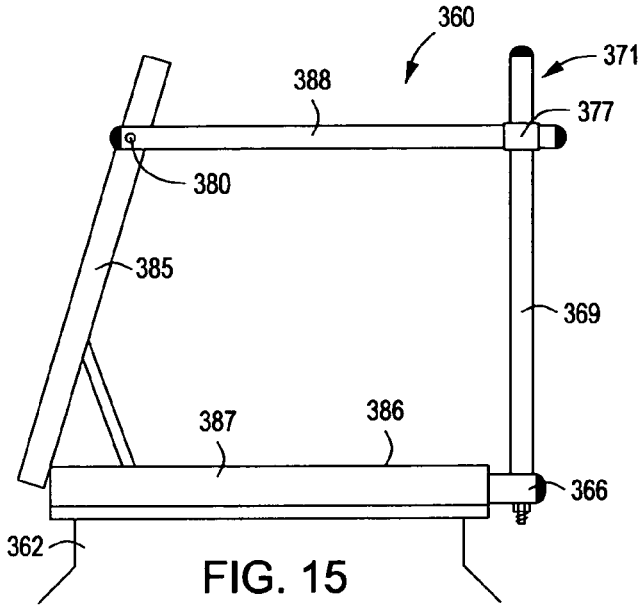
Figure 16:
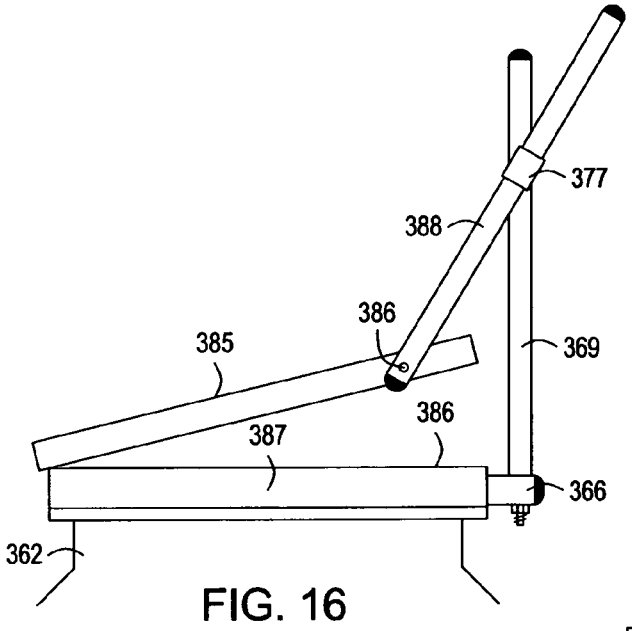
Figure 17:
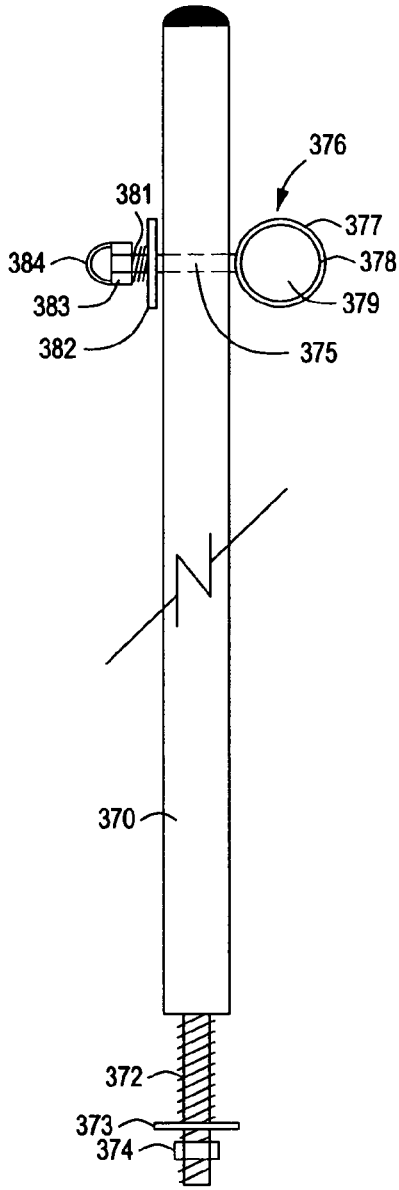
Figure 18:
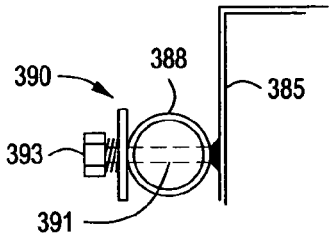
Figure 19:
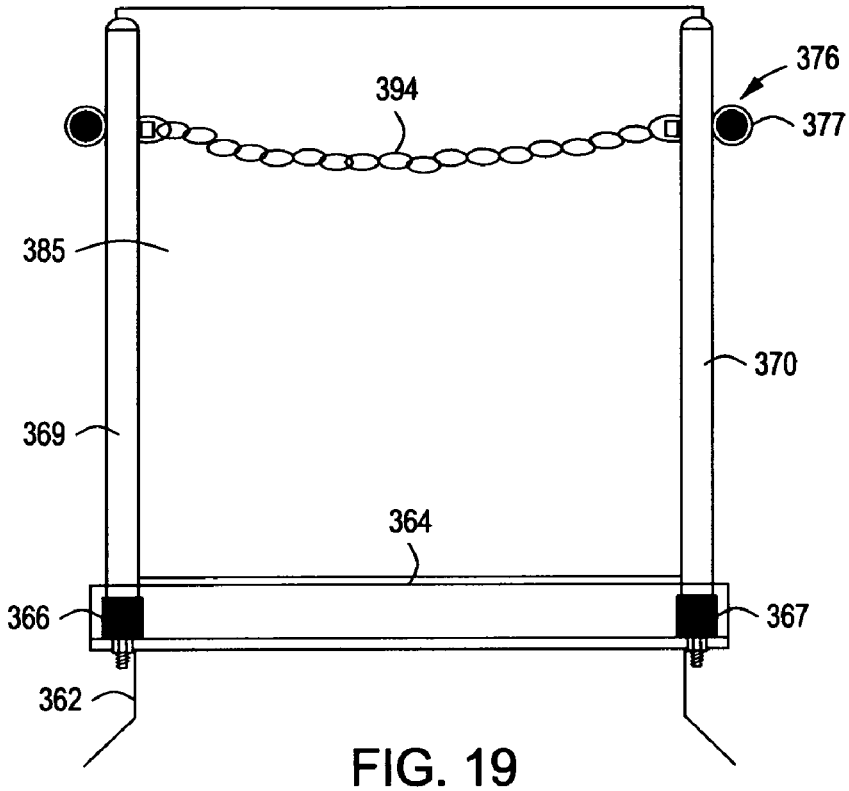
Figure 20:
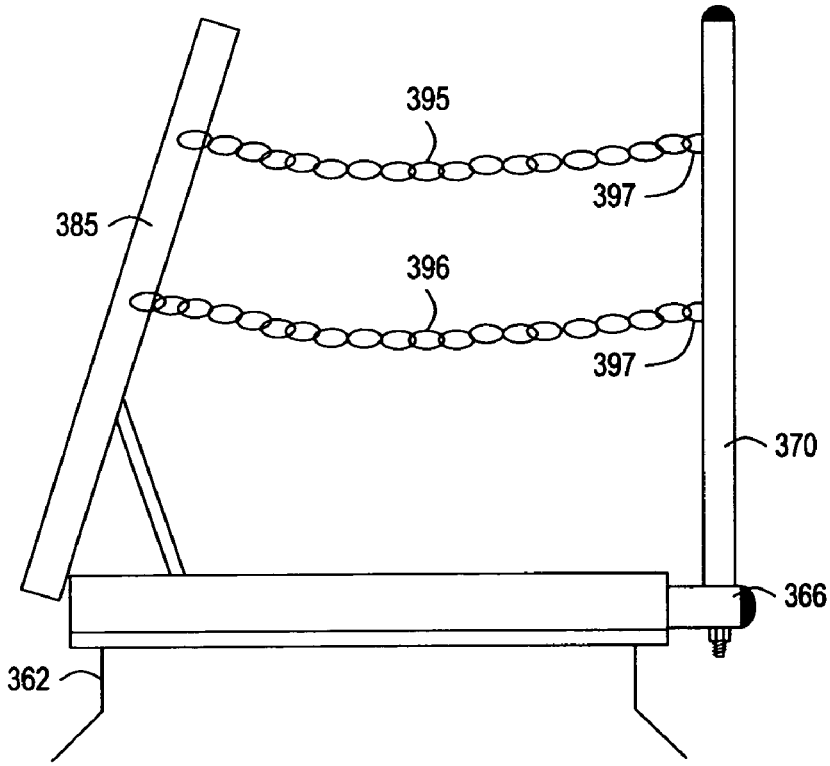

FIG. 9 is a partial sectional view taken along line 9-9 of FIG. 8 and showing the mounting details for securing a safety rail support to the mounting bracket;

FIG. 10 is a sectional view showing the safety hatch of the present invention in assembly with a side wall of the curb of a roof hatch or other similar structure, showing a safety rail mounting bracket having a safety rail support mounted thereto and further showing a structure for weather resistant juncture of a roof membrane with the safety hatch;

FIG. 11 is an isometric illustration of the safety rail mounting bracket of FIG. 10;

FIG. 12 is a plan view showing the safety hatch of the present invention alternatively serving as a weather resistant feature for a skylight, roof edge, roof hatch or any other roof opening of a building structure;

FIG. 13 is an isometric illustration showing the safety hatch of the present invention and further illustrating a safety rail support bracket being mounted to the curb of a roof hatch;

FIG. 14 is another isometric illustration showing the safety hatch of the present invention and further illustrating a safety rail support bracket providing support for a vertical support of a safety rail assembly;

FIG. 15 is a side elevational view of an alternative embodiment of the present invention showing a safety hatch mechanism having a collapsible safety railing operatively connected with the hatch and being shown at its raised or operative position upon opening of the hatch;

FIG. 16 is also a side elevational view of the alternative safety hatch embodiment of FIG. 15, showing the nearly closed position of the pivotally mounted hatch relative to the fixed curb and showing the partially collapsed condition of the safety rail assembly;

FIG. 17 is an elevational view of one of the upstanding posts of the safety rail assembly and further showing pivotal mounting of a tubular horizontal rail member thereto;

FIG. 18 is a partial sectional view of the hatch structure of FIGS. 15 and 16, showing a mounting assembly for establishing pivotal mounting of a horizontal rail member thereto;

FIG. 19 is an elevational view showing the front vertical fixed posts of the safety railing assembly with side rails mounted thereto and further showing a safety chain member being releasably mounted to chain connectors of the front vertical fixed posts; and FIG. 20 is a side elevational view of another embodiment of the present invention showing a safety rail assembly having side chain members that have ends mounted to the hatch member and being raised to operative safe condition upon opening of the hatch.

DETAILED DESCRIPTION OF PREFERRED EMBODIMENT

Figure 1:
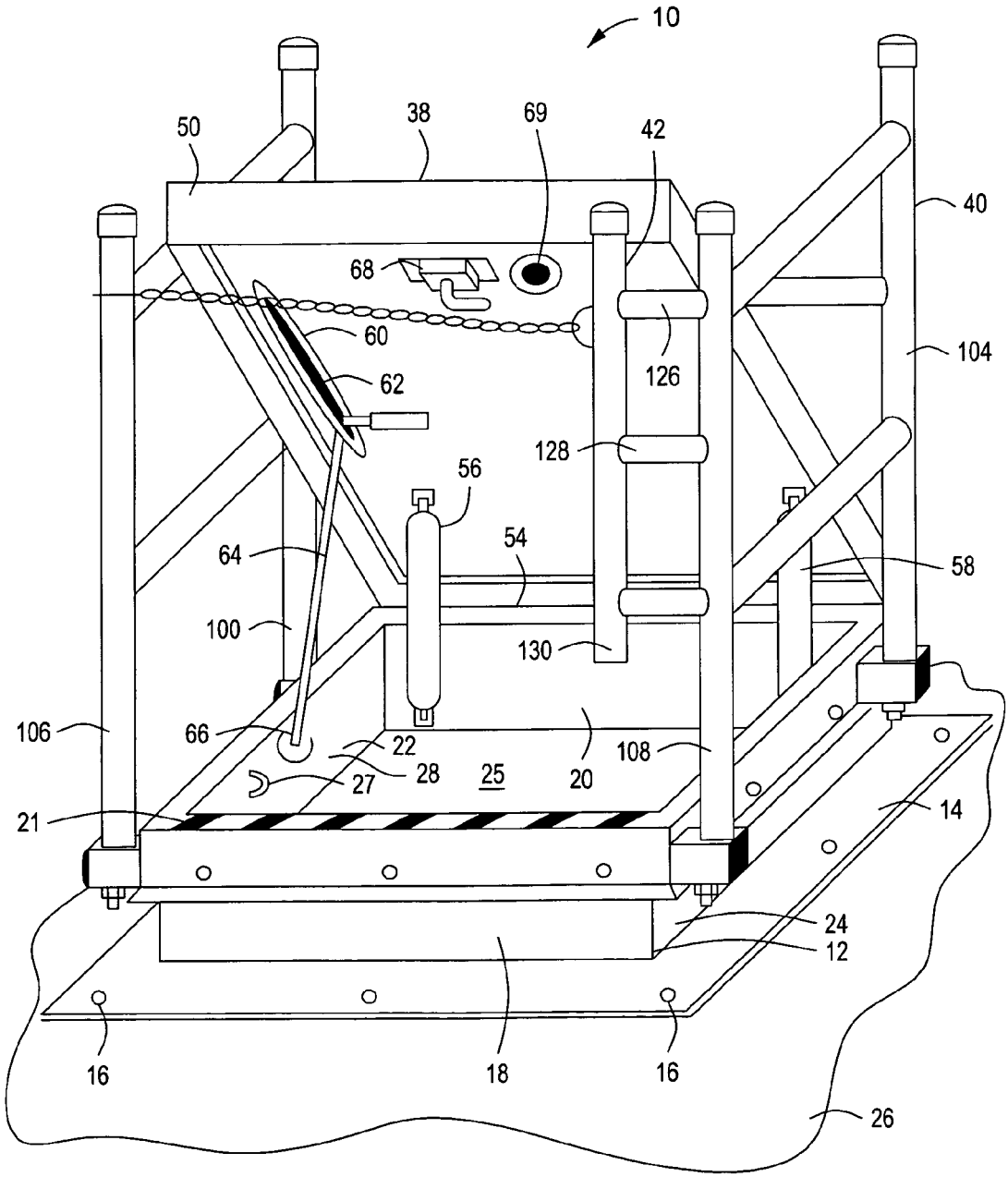

Referring now to the drawings and first to FIGS. 1-4 a safety hatch and safety rail assembly constructed according to the principles of the present invention is shown generally at 10 and is shown mounted to a curb shown generally at 12 having laterally extending curb flashing 14. The curb flashing 14 defines a plurality of holes 16 receiving fasteners such as nails screws or the like for securing the curb to a deck of a roof, floor or other structure of a building. The curb 12 is typically of rectangular configuration and defines a front wall 18, a rear wall 20 and side walls 22 and 24. The height of the front, rear and side walls of the curb 12, typically in the order of about 12", minimize the potential for access or leakage of water from the roof to the roof opening 25 that is circumscribed by the curb. When the apparatus is used as a roof access hatch a roofing membrane 26 of the roof will cover the curb flashing 14 and will extend upwardly along the front, rear and side walls of the curb 12 to provide for additional resistance to water leakage, such as might otherwise occur due to the build-up of snow and ice on the roof membrane. A safety ring member 27 is welded or otherwise fixed to the side wall 22 or the back wall 20 or both, so that workers may tether themselves to the safety ring with a harness strap or rope. In the event a worker should fall while accessing the stairway to the hatch opening 25 the harness strap or rope will minimize the potential for injuries by preventing the worker from falling to the floor below or falling on equipment that may be located adjacent the hatch access opening. The upper surface portion of the front hatch wall shown in FIG. 1 is preferably provided with a covering 21 composed of non-skid material to ensure that a worker will not tend to slip and fall into the hatch opening in the event the worker should step on the hatch wall. This non-skid material can also be brightly or dramatically colored, such as with alternating black and yellow stripes that make it especially visible and provide an effective warning that there is an edge at the hatch opening. The safety hatch structure is also well marked with warning labels to mark the danger of the hatch opening, make notice of Osha safety requirements and provide written and readily visible guidelines for fall protection under these conditions.

Figure 6:
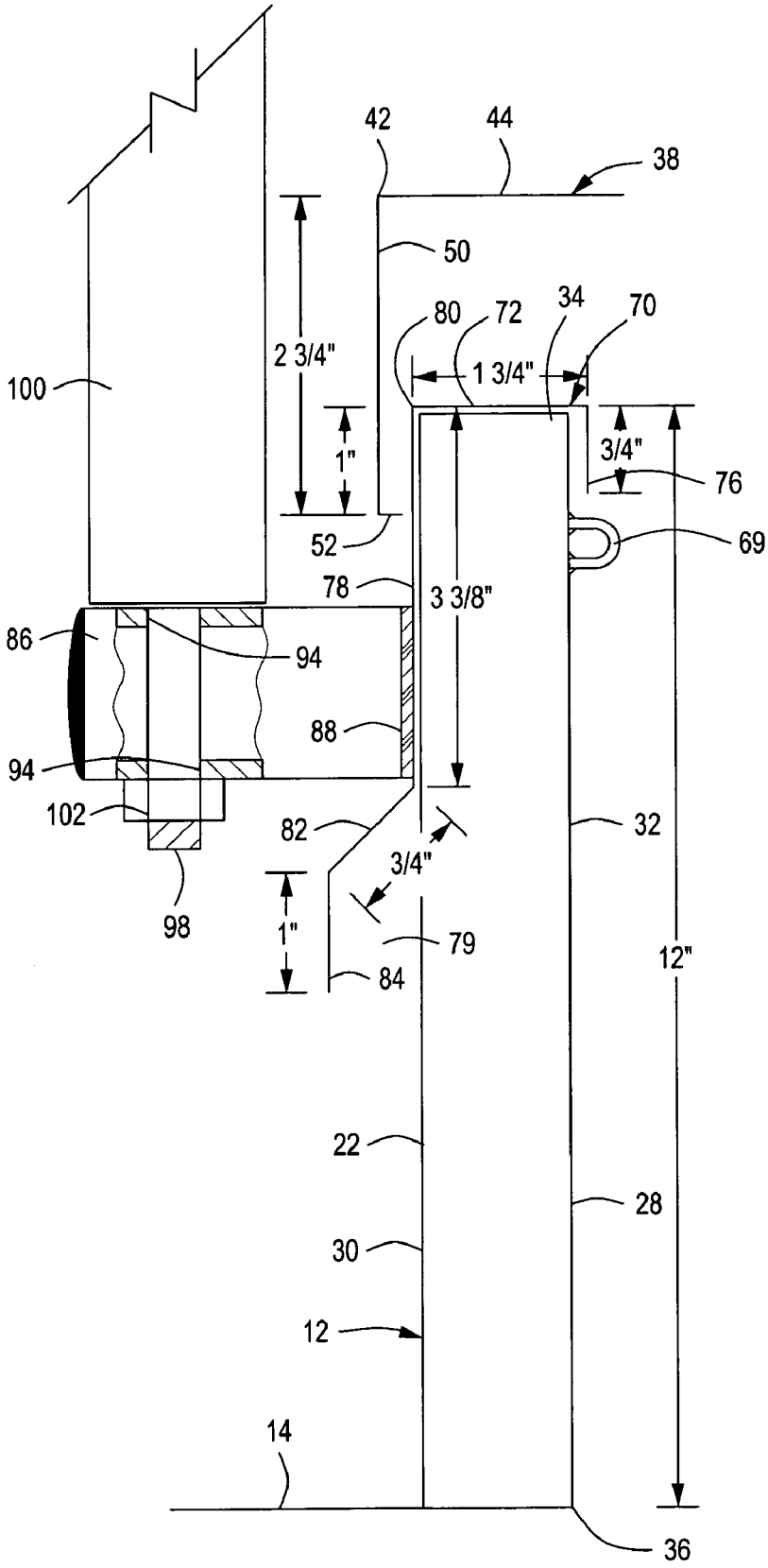

As is evident from the partial sectional view of FIG. 6, the walls of the curb 12, the side wall 22 being shown, each have interior surfaces 28 and exterior surfaces 30. The basic curb structure is often formed of wood, but may be composed of metal or a suitable polymer material. The interior surfaces of the front, rear and side walls of the curb 12 are lined with interior flashing 32 that extends from the upper rim 34 of the front, rear and side walls of the curb and is bent approximately 90° at its lower end 36 and extends beneath the respective curb wall member and beyond the wall member to define the curb flashing 14 that is intended to cover a portion of a roof membrane that is present about the access hatch opening of a roof system.

The safety hatch assembly of the present invention incorporates and provides support for a hatch cover or closure mechanism shown generally at 38 in FIG. 1 and a safety rail assembly shown generally at 40. The cover or closure mechanism 38 has a cover member 42 of generally rectangular configuration which is defined by a rectangular closure panel 44 which may be of planar configuration as shown in FIGS. 1 and 6 if desired or may be composed of sheet material that has bend lines, such as shown at 46 and 48 in the plan views of FIGS. 2-5 to provide the cover with panel with a somewhat domed configuration and to provide the closure panel with enhanced structural integrity. The cover member 42 has downwardly extending front, rear and side edge flanges 50, as shown particularly in FIGS. 1 and 6 which, in the closed position of the cover are disposed in spaced relation with the exterior surfaces 30 of the front, rear and side walls of the curb structure. Thus, as water drains from the front, rear and side flanges of the cover it will drip onto the roof membrane rather that being wicked upwardly by capillary activity to the rims 34 of the curb members. The structural integrity of the front, rear and side edge flanges 50 is enhanced by the provision of inwardly projecting lower edge flanges 52 which are formed by bending or otherwise forming the sheet material from which the front, rear and side edge flanges 50 are composed.

The cover member 42 is mounted to the curb structure by one or more hinges 54 as shown in FIG. 1 thus permitting the cover member 42 to be pivotally moved from an open position allowing movement of personnel through the roof access opening 25 to a closed position where the cover member 42 engages the upper rims of the wall members of the curb 12 and closes the roof access opening. To permit ease of opening and closing the cover member 42, one or more compression spring operator devices 56 and 58 or other shock absorber devices are connected to the rear wall 20 of the curb structure and are also connected to the inside surface of the cover panel 44. The compression spring operators serve as closure control devices for the hinged cover and minimize the potential for dead weight slamming of the cover member 42 against the upper rim of the curb if the cover is inadvertently released. Since the cover member 42 may need to be secured at its open condition for extended periods of time the cover member is provided with a closure positioning bracket member 60 that is also fixed to the inner surface of the cover panel 44. The bracket 60 may be of the L-shaped type having an elongate slot 62 through which extends a shaft 64 of a cover positioning control arm 64. The lower end 66 of the cover positioning control arm 64 is pivotally mounted to the interior surface 28 of the side wall 22 of the curb. At the open position of the cover member 42 the shaft 64 will engage within an off-set portion of the elongate slot 62 and secure the cover member against closing movement. A latch mechanism 68 serves to secure the cover member in its closed condition and is actuated for unlocking of the cover member and for moving the cover member to its open condition. For additional safety a warning light and/or alarm 69 is mounted to an inside surface of the hatch cover or closure to provide a ready indication to personnel on a roof, especially during conditions of darkness or poor light, that the hatch cover is open. Since the hatch is provided with a safety railing, a warning light or alarm is typically an optional feature but serves to warn personnel that there is a safe opening but precaution should be taken. A light or alarm also provides a signal to personnel, especially at night, that a safe roof exit exists at the location of the light or alarm. The light and or alarm will be activated when the hatch closure has been opened and will be turned off when the hatch closure is moved to its closed position.

An important feature of the safety hatch of the present invention is the provision of a mounting system for a safety rail assembly such as is shown generally at 40 in FIG. 1 to permit safe egress and ingress of personnel and service materials through the roof opening 25. It is also important to provide the curb structure with upper edge and rim flashing for protection thereof and to provide for support and positioning of a plurality of safety rail mounting brackets.

With reference to the partial sectional view of FIG. 6 upper edge and rim flashing shown generally at 70 incorporates a transverse rim flashing section 72 that is disposed in surface to surface engagement with the upper rim 34 of the curb structure. The transverse rim flashing section 72, according to one embodiment of this invention, may have a width of about 1½, which is greater than the thickness of the respective curb wall member. The transverse rim flashing section 72 has a downwardly projecting interior flange 76, which may have a width of about ¾", and is integral with the transverse rim flashing section 72 and covers an upper edge portion of the interior flashing 32.

The upper edge and rim flashing defines an exterior flashing section 78 which is disposed in laterally spaced relation with the exterior surface 30 of the respective wall member of the curb 12 as is evident from FIG. 6. The exterior flashing section 78, according to the preferred embodiment of the present invention may extend downwardly about 3⅜" from the transverse rim flashing section 72 and may have a spacing of about ½ inch from the outer wall surface 30 of the curb, thus defining a downwardly facing perimeter receptacle 79 externally of the curb walls. It is to be understood, however, that the specified width and length of the transverse rim flashing section and the exterior flashing section of the upper edge and rim flashing 70 set forth herein is not intended to to limit the spirit and scope of the present invention in any manner, but is merely representative of one example of the invention. From the lower end of the exterior flashing section 78 extends an angulated flashing section 82 that is integral with or connected to the exterior flashing section 78 may have a length of about ¾". The flashing sections may have greater or lesser length or width without departing from the spirit and scope of the present invention. A lower terminal flashing section 84, which may have a length of about 1", is integral with or connected to the angulated flashing section 82.

To provide for releasable mounting of the safety railing assembly shown generally at 40 to the upper edge and rim flashing of the safety hatch, a rear safety rail support bracket 86 is mounted to the exterior flashing section 78 by weld connection 88. Similarly, front safety rail support brackets 90 are mounted to the exterior flashing section 78 by weld connection 92. If desired, the front and rear safety rail support brackets may be of substantially identical configuration, however, to achieve positioning of the front portion of the safety rail assembly forwardly of the front wall of the curb according to the preferred embodiment of this invention, the front safety rail support brackets are configured for angulated position with respect to the side walls and front wall of the curb 12. Preferably the front and rear safety rail support brackets are composed of tubular bar stock having a rectangular cross-sectional configuration, however if desired the safety rail support brackets may be manufactured from solid bar stock. As shown in FIGS. 5, 5A and 6, the rear safety rail support bracket 86 defines attachment holes 94 through which the threaded mounting bolts 98 of safety rail support posts 100 extend. Mounting nuts 102 are employed to secure the safety rail support posts 100 in releasable assembly with the safety rail mounting brackets. In similar fashion the front safety rail mounting brackets 90 define attachment holes 96 through which the threaded mounting bolts of safety rail support posts extend as shown in broken lines in FIGS. 2, 3 and 4, the post and bracket connection being shown in detail in FIG. 6. Mounting nuts 102 are employed to secure the safety rail support posts 100 in releasable assembly with the safety rail mounting brackets. In similar fashion the front safety rail mounting brackets 90 define attachment holes 96 through which the threaded mounting bolts of safety rail support posts extend.

Figure 2:
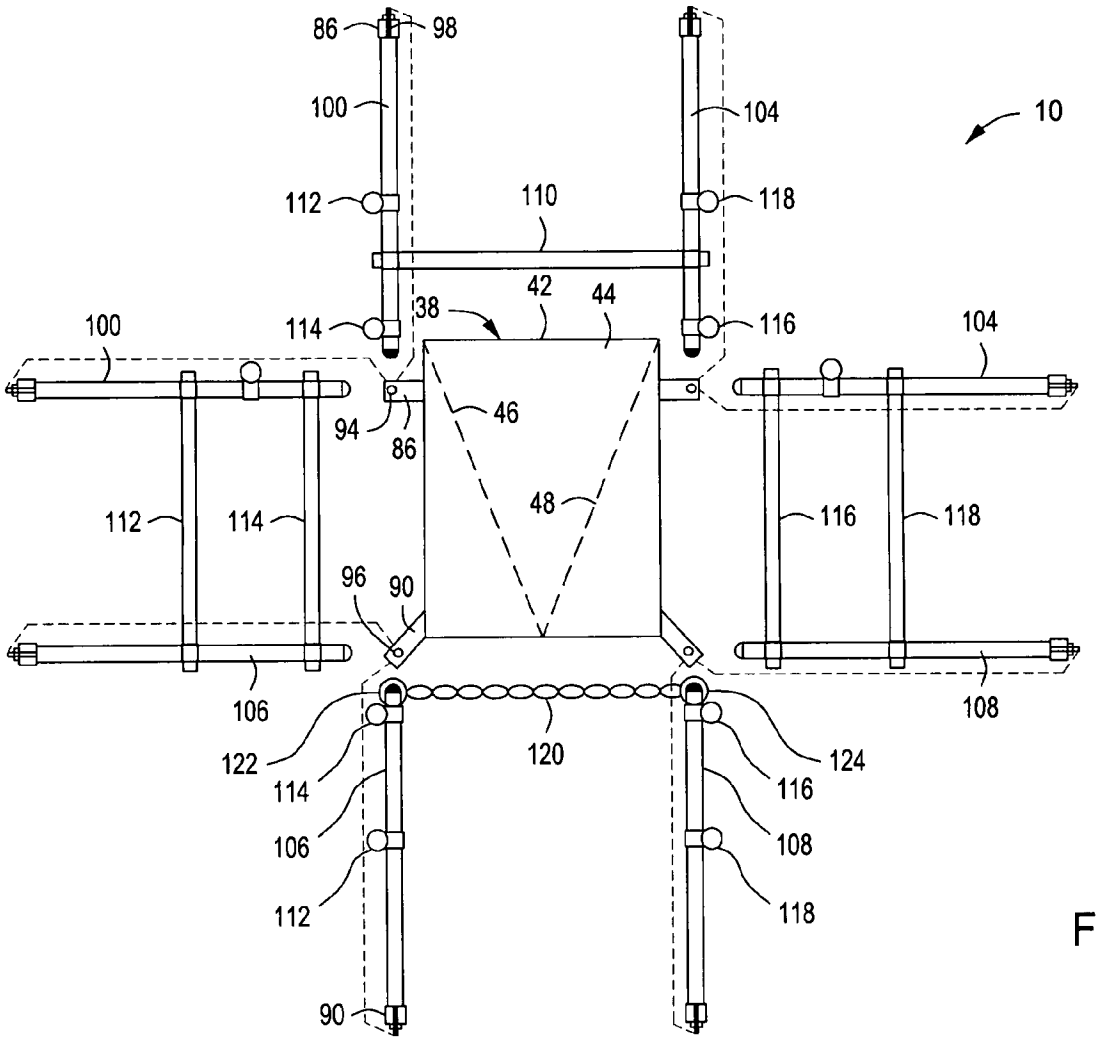

Referring now to FIG. 2, the plan view illustrates the safety hatch of the present invention and further shows a safety rail assembly by means of exploded view. Four safety rail support posts are shown, with rear support posts shown at 100 and 104 and with front safety rail posts shown at 106 and 108. In each case the support posts are shown with the mounting bolts being shown extending through the mounting holes of respective front and rear mounting brackets shown in section. To the rear safety rail support posts 100 and 104 is mounted a horizontal safety bar 110. Similar safety bar members 112 and 114 have respective end portions thereof mounted to the safety rail support posts 100 and 106. On the opposite side of the safety hatch and safety rail assembly horizontal safety bar members 116 and 118 are shown to have respective ends thereof mounted to the rear support post 104 and the front support post 108. Since personnel will pass between the front support posts 106 and 108, a safety chain 120 is releasably positioned between the front support posts and has connecting members 122 and 124 at least one of which is releasable from one of the front support posts.

According to current OSHA rules a safety railing of a roof hatch can have a personnel opening having a width no greater than 36" and no less than 18". To accommodate the OSHA rules concerning the width of the personnel openings of safety rail systems, where roof hatches have a width greater than 36", the safety rail structure of the present invention have intermediate "grab post" members enabling personnel to stabilize themselves as they move through these personnel openings. With reference to the isometric illustration of FIG. 1 and the exploded plan view of FIG. 3 there is shown a safety rail structure that differs from the safety rail structure of FIG. 2 in that the access gap between the front support posts 106 and 108 is reduced in width.

Figure 3:
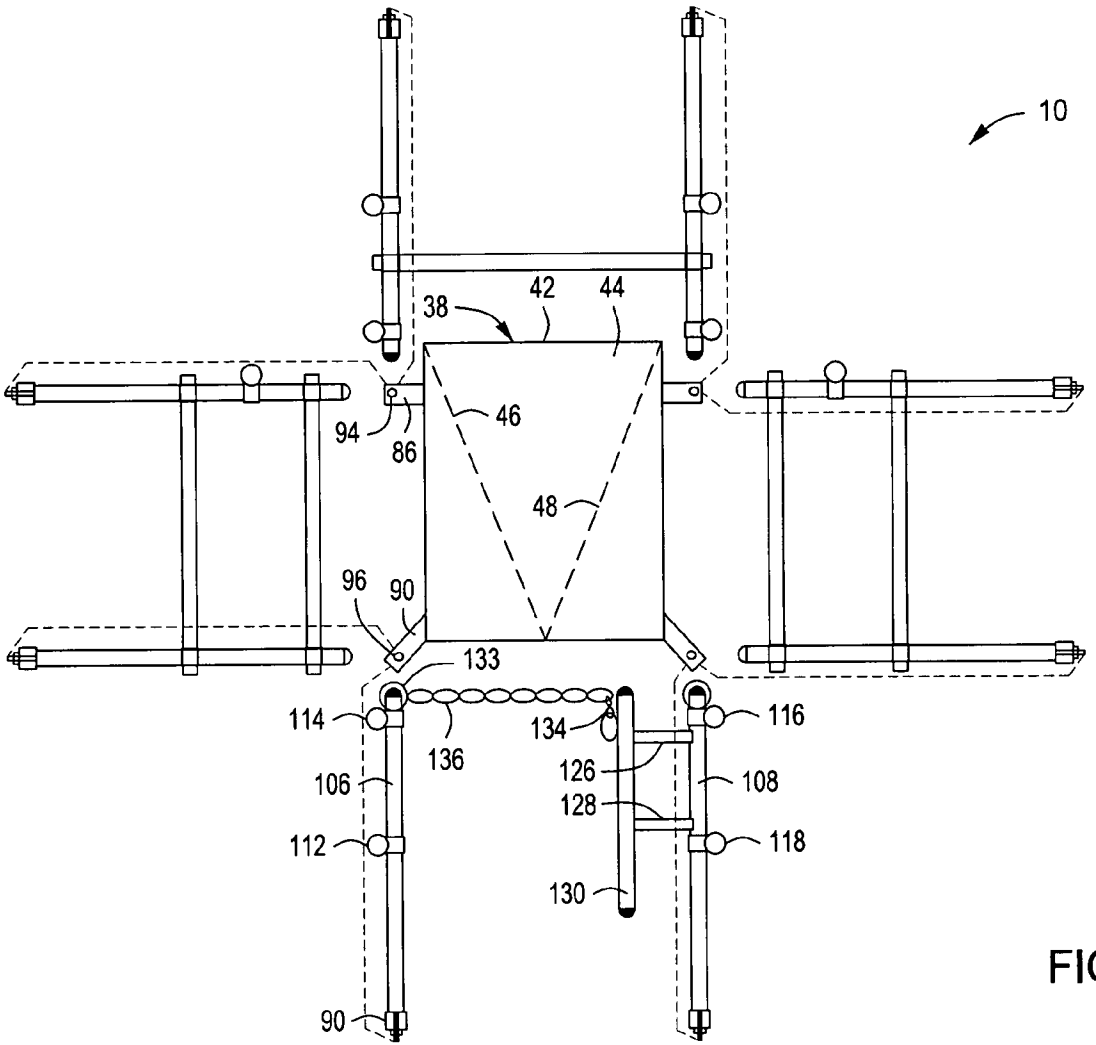
Figure 4:
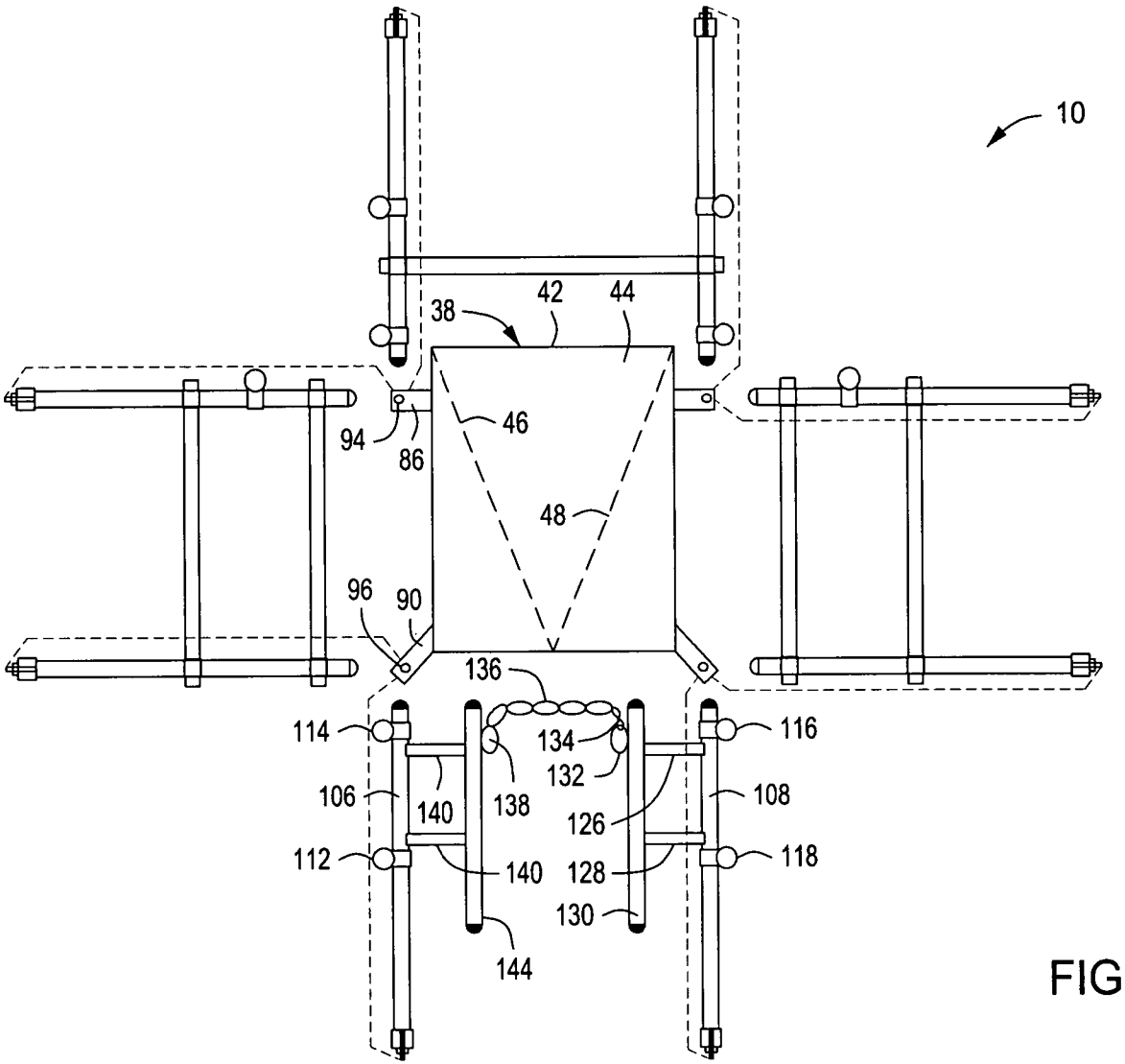
Figure 5:
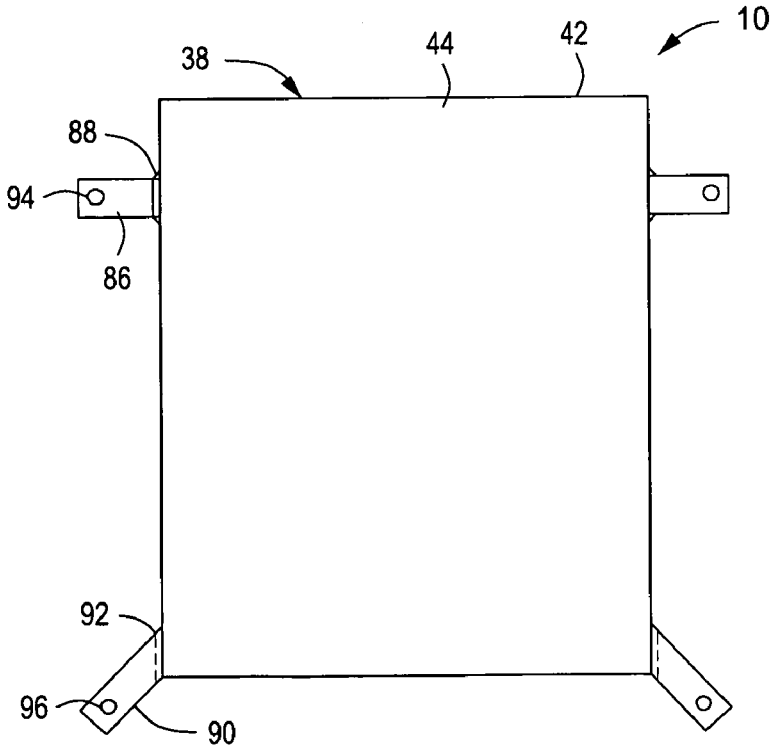
Figure 5A:
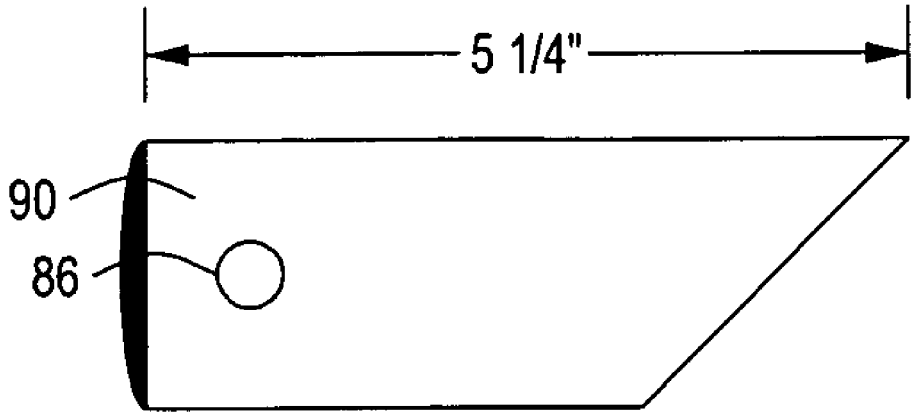

As shown in FIGS. 1, 3 and 4, two or more lateral support members 126 and 128 are disposed in spaced relation and have one of the ends thereof fixed to the front safety rail support post 108. The opposite ends of the lateral support members 126 and 128 are fixed to a vertically oriented intermediate support member or "grab post" 130. Connection of the end portions of the lateral support members 126 and 128 to the front support post 108 and the intermediate support member 130 may be established by welding or by any other suitable means for attachment. The intermediate support member 130 is provided at or near its upper end with a connecting ring 132 to which a snap connector or spring swivel 134 of a safety chain 136 may be releasably connected. The opposite end of the safety chain is fixed to the upper portion of front support post 106 by means of a connecting ring 138.

Though the intermediate support member is secured to the front support post 108 by lateral support members 126 and 128, it should be borne in mind that that the intermediate support member or "grab post" 130 may be positioned in laterally spaced and substantially parallel relation with the front support post 108 by any suitable support structure. For example, a web of plate material may be welded or otherwise attached to the front support post 108 and the intermediate support member or "grab post" 130 to provide a post supporting structure. In the alternative, the connecting and supporting members 128 and 130 may be oriented other than generally horizontal and parallel. In point of fact, any supporting structure or device that achieves safe support of an intermediate support member to reduce the width of the space between the front corner posts 106 and 108 may be employed within the spirit and scope of the present invention.

Figure 4A:
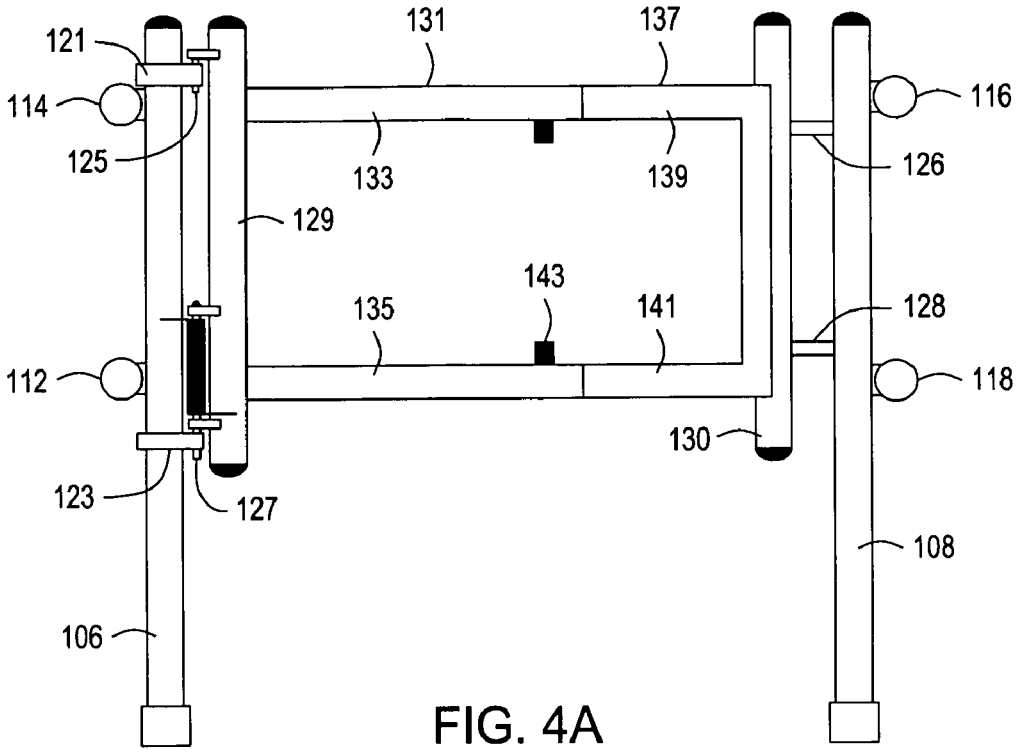

Referring now to FIG. 4, the plan view illustrates a safety hatch and safety rail assembly that differs from that shown in FIG. 3 in that the access gap between the front support posts 106 and 108 is further reduced in size. Upper and lower lateral support members 140 and 142 have ends thereof fixed to the front support post 106, such as by welding, and have the opposite ends thereof fixed to another intermediate support member 144 so that the space between the intermediate support members is only wide enough to permit a worker to pass between them. Additionally, the intermediate support members serve efficiently as hand-holds to permit personnel to secure and stabilize themselves to prevent falling as the access stairway is used. A safety chain 146 of less length as compared with the safety chains 120 and 136 has one end thereof connected with the intermediate support member 144 by any suitable connector and has the opposite end thereof releasably connected with the connecting ring 132 by a snap connector or spring swivel 134 or by any other suitable means for releasable connection. As shown in FIG. 4A, much the same guard rail arrangement is shown, as compared with FIG. 4 and like parts are indicated by like reference numerals. Hinge clamp members 121 and 123 are mounted to the front safety rail post 106 and provide hinge or pivotal support with gate hinge pins 125 and 127 that are fixed to a support member 129 of a gate member 131. The gate member 131 is defined in part by tubular structural members 133 and 135. A gate end member 137 has laterally extending adjustment members 139 and 141 that extend into the tubular structural members 133 and 135 and permit the width of the gate member to be selectively adjusted. Adjustment locking members 143 are mounted to the tubular structural members 133 and 135 and engage within adjustment holes of the adjustment members 139 and 141. A hinge spring member 145 is mounted about the hinge pin 127 and provides a continuous spring force acting on the gate and urging the gate to its closed position. The gate member 131 can be easily opened from the hatch side simply by walking through the gate opening and pushing the gate open. To open the gate from the opposite side a worker will simply pull it open; after which the self-closing characteristic of the gate member will move it to its closed position by means of the spring force of the hinge spring member 145. If desired, the gate member may be provided with a simple latch for securing it at its closed position when its use is not needed.

Figure 7:
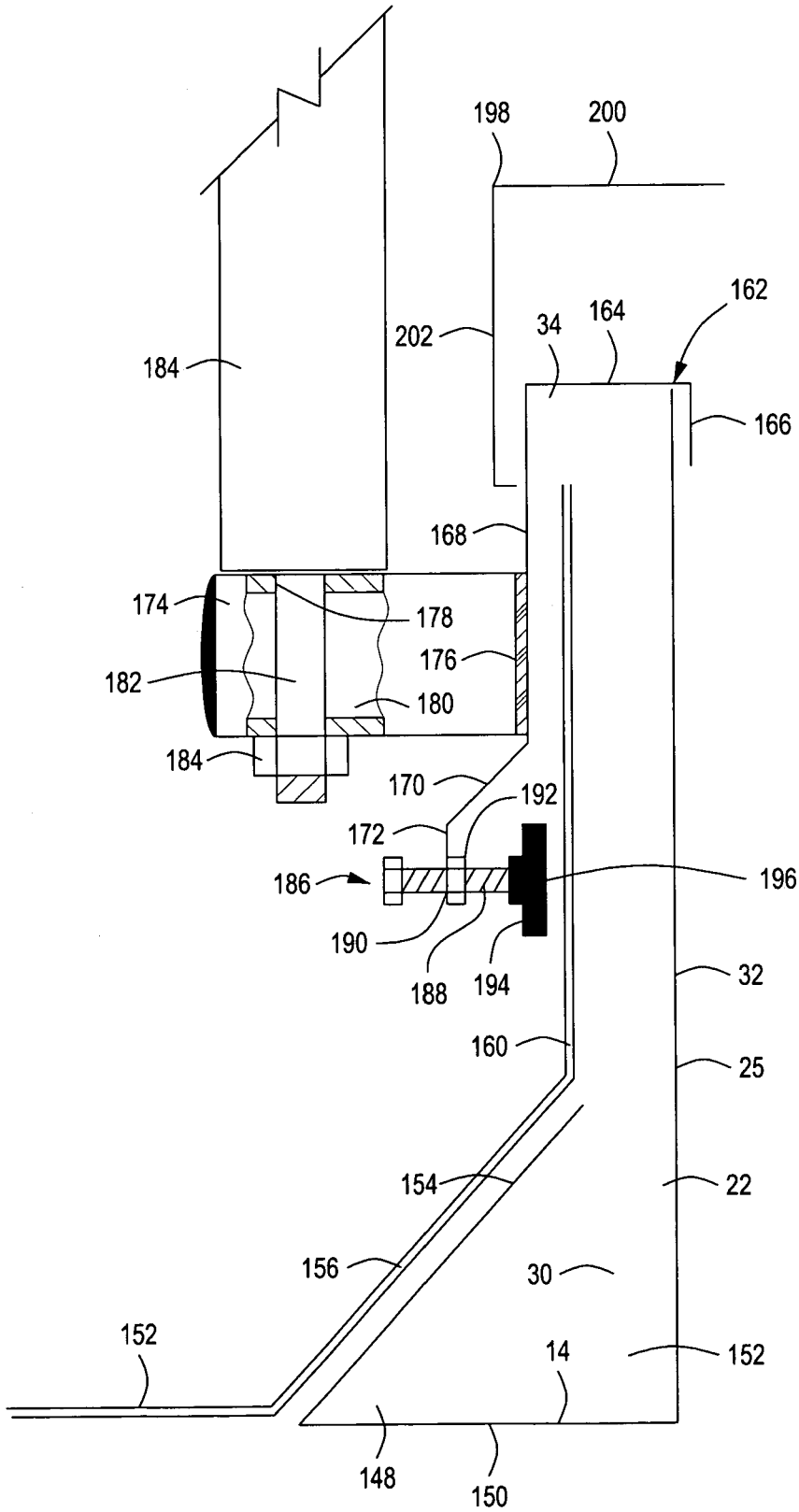

With reference to FIG. 7 an alternative embodiment of the safety hatch and safety rail assembly of the present invention is shown. A side wall 22 of a roof access hatch curb structure is shown to have interior and exterior curb surfaces 28 and 30 as discussed above in connection with FIG. 6. The curb structure is provided with interior flashing 32 having a lower horizontally oriented curb flashing portion 14. A fillet member 148 has a lower surface portion 150 that is seated on the curb flashing portion 14 and an upright surface portion 152 that is disposed in abutting relation with the exterior surface 30 of the curb wall member 22. The fillet member 148 also defines an angulated surface portion 154 which is disposed for supporting engagement of an angulated section 156 of a roof membrane 158. The roof membrane is also provided with an upright membrane section 160 that extends upwardly along the exterior surface 30 of the curb wall member 22. Though the roof membrane is shown to be disposed in spaced relation with the angulated surface portion 154 and the exterior surface 30 of the curb wall member, for purposes of clarity, it should be borne in mind that the roof membrane may have surface to surface engagement with these surfaces.

The safety hatch and safety rail assembly of the present invention has upper edge and rim flashing shown generally at 162 having a horizontally oriented rim section 164 that overlies the rim 34 of the curb wall members. The upper edge and rim flashing 162 defines a downwardly extending integral edge flange 166 that extends over the upper edge portion of the interior flashing 32 and secures it to the curb wall member. An exterior flashing section 168 is integral with the horizontally oriented rim section 164 and extends downwardly along the exterior surface 30 of the curb wall member 22. The width of the horizontally oriented rim section 164 is greater than the width of the rim surface 34 thus positioning the downwardly extending exterior flashing section 168 in spaced relation with the exterior surface 30 of the curb wall member 22, the spacing being in the order of ½" as discussed above in connection with FIG. 6. The exterior flashing section 168 defines an integral angulated flashing section 170 that extends downwardly and outwardly and provides support for a lower terminal flashing section 172 that is oriented in substantially parallel relation with the exterior surface 30 of the curb wall member.

For support of a safety rail assembly a safety rail support bracket 174 of generally rectangular cross-sectional configuration is connected to the downwardly extending exterior flashing section 168 by welding along weld line 176. As shown in the partial sectional view of FIG. 7 the support bracket defines bolt holes 178 and 180 through with the mounting bolt 182 of a safety rail support post 184 extends. A mounting retainer nut 184 is threaded to the lower end of the mounting bolt 182 and secures the support post to the bracket member.

A plurality of adjustable clamping and positioning members, one of which is shown generally at 186, are mounted to the lower terminal flashing section 172. Each of the adjustable clamping and positioning members is defined by a threaded bolt member 188 having a bolt shaft that extends through one of a plurality of holes 190 that are defined in the lower terminal flashing section 172. A lock nut 192 is threaded to the threaded bolt shaft and is rotatably adjusted to lock the bolt member against movement relative to the lower terminal flashing section 172. The lock nut member 192 may be composed of metal and welded or otherwise fixed to the inner surface of the lower terminal flashing section 172 to facilitate ease of assembling the threaded bolt member 188 to the lower edge of the flashing. Alternatively, the nut member may be composed of a suitable polymer material and may have a portion thereof retained within a nut mounting hole of the flashing. In such case the nut would simply be attached to the flashing edge within the hole and the bolt or other clamp or retainer device would be secured to the nut and adjusted as desired. A clamp plate member 194 is supported by the end of the bolt shaft and defines a large, generally planar clamp surface 196 that is disposed for clamping engagement with the upright membrane section 160. The clamp plate member functions to secure the upright membrane section 160 in place and to stabilize and secure the upper edge and rim flashing 162 at a desired position with respect to the front, rear and side walls of the curb structure. The adjustable clamping and positioning members function to stabilize and strengthen the lower edge of the flashing and also serve to secure the roofing membrane between the flashing and the outer surfaces of the walls of the curb.

The safety hatch and safety rail assembly of FIG. 7 is completed by a pivotally mounted closure or cover member 198 having a closure top wall panel 200 and a downwardly extending closure edge flange 202 which is of essentially the same structure and function as described above in connection with FIG. 6.

According to FIGS. 8 and 9 it may be desirable to provide safety rail support brackets that can be fixed to the exterior wall surfaces of a curb structure by means of fastener devices such as screws, mounting bolts and the like. To provide this feature a bracket support plate 204 defines a plurality of fastener holes 206 through which fastener members extend. The fastener members also extend through any exterior flashing that may be present and through the upstanding portions of a roofing membrane and are threaded into or otherwise secured within the wall structure of a safety hatch curb. Though shown in FIG. 8 to be of rectangular configuration, the bracket support plate 204 may be of any other desired configuration without departing from the spirit and scope of the present invention. A safety rail support bracket 208 of the configuration shown at 174 in FIG. 7 is welded or otherwise fixed to the bracket support plate 204 along weld lines 205 to provide for support of one of the safety rail support posts 210 of a safety rail assembly. It should be borne in mind that the illustration showing the bracket support plate is also representative of the safety rail support brackets 86 of FIGS. 6 and 174 of FIG. 7 and the manner by which these brackets are mounted to the exterior flashing section of the upper edge and rim flashing. The outer portion of the rectangular safety rail support bracket 208 is closed by a closure plate 212 that is welded or otherwise fixed to the support bracket. If desired the closure plate 212 may be composed of a suitable polymer material and may have a retainer portion that is simply pressed into a rectangular end opening of the support bracket so that it is retained in place by a friction fit.

The safety rail support post 210, as shown in the sectional illustration of FIG. 9, is of cylindrical tubular configuration, though it may be of any other tubular or solid cross-sectional configuration without departing from the spirit and scope of the present invention. A mounting plate 214 is located within the interior passage 216 and is positioned in spaced relation from the end 218 of the support post. The mounting plate may be secured within the interior passage by welding, as shown at 220 or in the alternative may be seated on an annular support shoulder that may be fixed or otherwise located within the interior passage. As indicated above, the safety rail support bracket 208 defines upper and lower support post mounting holes 222 and 224 that are disposed in registry. A mounting bolt 226 is positioned with its head portion 228 located within the interior passage 216 and seated on the mounting plate 214. The threaded shaft 230 of the post mounting bolt 226 extends through a central hole 230 of the mounting plate 214 and through the aligned holes 222 and 224 of the bracket member 208. A lock nut 232 is received by the threaded shaft 230 and is tightened to secure the safety rail mounting post 210 to the top surface of the bracket 208. The mechanism for mounting the safety rail support posts to the various mounting brackets is employed regardless of the manner by which the mounting brackets are secured to the safety hatch structure.

Referring now to FIGS. 10 and 11, it may be desirable to provide an independent support device or structure for each of the support posts of the safety rail system. This feature is accomplished by providing a safety hatch assembly, shown generally at 240, having a curb structure defining a curb wall member 242. The curb structure is provided with interior flashing 244 that extends along and provides a waterproof covering for the interior surface 246 of the curb members and is bent or otherwise formed along bottom line 248 to define deck mounting flashing 250 that extends beneath the curb wall member 242 and past the outer wall surface 264 of the curb wall structure to provide flashing that engages the deck 252 of the roof or other structure to which the curb is mounted. The curb structure includes a fillet member 254 defining an angulated surface 256 to further strengthen the curb structure and to provide a support surface for a portion 258 of a roofing membrane 260. Another portion 262 of the roofing membrane 260 is upstanding and extends along the exterior surface 264 of the curb wall structure 242.

The curb structure 242 of the safety hatch assembly is shown in FIG. 10 to be provided with a wood cap member 266 that provides an upper curb rim surface 268. The safety hatch assembly further incorporates a pivotally mounted hatch cover or closure, shown generally at 270, which may be of the general configuration and function that is shown and discussed above in connection with FIGS. 1 and 6. Rather than having a flat or tapered upper closure panel as shown in earlier Figures of the drawings, the hatch cover or closure 270 is shown to have a generally rectangular closure panel 272 to which is mounted or formed a domed closure panel 274. The domed domed closure panel may be composed of transparent or translucent polymer material or a suitable glass material so that the closure panel will have the function of a skylight. FIG. 12 is a plan view of the safety hatch of the present invention, showing that it can be used as a moveable closure for a roof hatch, roof edge or skylight or any other roof or deck opening of a building. The rectangular closure panel 272 also has a downwardly extending perimeter flange 276 that overlies and provides waterproof protection for the upper edge portion of the curb structure. The perimeter flange 276 is spaced from the exterior wall surface 264 and the upstanding roofing membrane portion 262 so that any water drainage from the perimeter of the closure will drip from the perimeter flange and will not be drawn upwardly along the inside surface of the perimeter flange by the wicking activity of capillary attraction or osmosis.

As shown in FIGS. 10, 11 and 13, it may be desirable to provide independent support for each of the safety rail support posts, thus permitting the spacing of the safety rail support posts to be adjusted as desired and permitting the safety rail assembly to be removably assembled to the curb structure of the safety hatch assembly if desired. Safety rail support bracket assemblies, shown generally at 280, have a hanger structure 282 defined by a horizontally oriented hanger mount plate 284. The mount plate 284 defines fastener holes 286 through which fasteners 288, such as nails or screws extend, as shown in FIG. 10, for securing the horizontally oriented hanger mount plate 284 to the cap member 266 of the curb. A hanger plate 290 is fixed to or integral with the mount plate 284 and is oriented in 90° angular relation with the mount plate so that it extends along and in parallel relation with the upper portion of the front wall surface 264 of the curb and the upstanding roof membrane section 262. The hanger plate 290 defines fastener holes 292 through which fasteners 294, such as nails or screws extend to fasten the hanger plate to the cap member 266 of the curb structure.

A safety rail support bracket 296, which may be of essentially the same structure and function as compared with bracket 86 of FIG. 6 and bracket 174 of FIG. 7, is welded to the hanger plate 290 along weld lines 298 and 300. The bracket 296 defines upper and lower attachment holes, such as shown at 302, which are disposed in vertical registry to receive a threaded mounting bolt 304 of a safety rail support post 306. A retainer nut 308 is threaded to the mounting bolt 304 to secure the safety rail support post 306 to the bracket 296.

With reference to FIG. 13, a bracket hanger structure is shown generally at 310 which is adapted for mounting to the upper rim portion of the curb 312 of a safety hatch, roof mounted skylight or the like. The curb 312 has curb walls having an interior wall surface 314 and an exterior wall surface 316. Interior flashing 318 extends from the rim surface 320 downwardly along the interior wall surface 314 and is bent or otherwise formed at its lower end to define a laterally extending deck flashing section 322 that extends beneath the curb wall members. The deck flashing section 322 will typically include attachment holes as shown at 14-16 in FIG. 1 to permit attachment of the flashing to a deck structure by means of nails, screws or any other suitable fasteners.

According to FIG. 13, the curb structure is provided with upper edge and rim flashing, generally shown at 324 having a rim flashing section 326 that covers the rim surface 320 of the curb walls 312. The flashing 324 also includes a depending interior attachment flange 328 that is preferably integral with the rim flashing section 326 and is oriented in substantially 90° relation with the rim flashing section. The interior attachment flange 328 extends along the upper interior edge of the curb wall and is provided with attachment holes through which fasteners 330 such as screws or nails extend to secure the flange to the upper edge portion of the inner surface 314 of the curb wall. The upper edge and rim flashing 324 also has an integral or physically connected downwardly extending exterior flashing section 332 which is disposed in spaced relation with the exterior surface 316 of the curb walls. This spaced relationship permits roofing membrane to be located between the exterior surface 316 and the exterior flashing section 332. The spaced relationship also allows draining water to drip from the lower portion of the exterior flashing section 332 and prevents the draining water from being drawn upwardly to the rim surface of the curb structure. The exterior flashing section 332 further includes a lower outwardly angulated section 334 and a lower flashing edge 336.

The bracket hanger structure 310 is preferably provided in the form of an integral structure, but if desired it may be formed of interconnected components. The safety rail support brackets 310 each have a hanger structure 338 that is defined by a horizontally oriented hanger rim plate 340. From the hanger rim plate extends a downwardly projecting mounting flange 342 that covers the upper edge of the interior flashing 318. Fasteners 344, such as nails or screws extend through holes of the flange 342 and through holes of the depending interior attachment flange 328, as shown in FIG. 10, for securing both of the depending flanges to the upper edge portion of the curb wall members 312. From the horizontally oriented hanger rim plate 340 an exterior hanger plate 346 extends downwardly along the exterior flashing section 332 to an offset hanger panel 348. A bracket mount panel 350 extends further downwardly from the offset hanger panel 348 and is of sufficient vertical height for mounting a generally rectangular safety rail support bracket member 352 thereto.

Figure 5B:
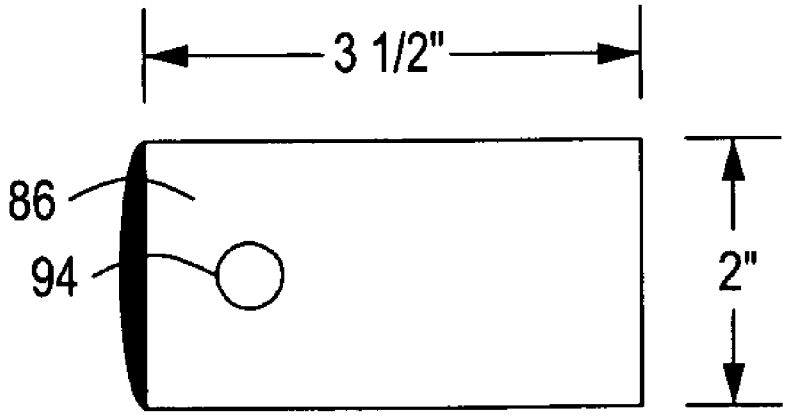

The bracket member 352 is preferably mounted to the bracket mount panel 350 by welding along weld lines 354. Preferably the lower portion of the bracket mounting panel has a reverse bend 356 from which a flashing section 358 projects upwardly in spaced relation with the bracket mounting panel, thus defining a slot 359 receiving the lower flashing edge 336 therein. The reverse bend also enhances the structural integrity of the lower end of the upper edge and rim flashing and secures the lower flashing edge 336 against possible damage. Though the bracket member 352 is shown to project outwardly in substantially normal relation with the bracket mount panel 350, it should be borne in mind that it may be of the configuration shown at 90 in FIGS. 5 and 5B so that it projects outwardly and in angular relation from the mount panel.

In FIG. 14 another embodiment of the safety hatch of the present invention is shown which is essentially of the structure and function of the safety hatch of FIG. 6, with like components thereof being identified by like reference numerals. The safety hatch of FIG. 14 differs from the embodiment of FIG. 6 only in that the exterior flashing section 78, below the safety rail support bracket 86 defines an angulated flashing section 82 having a reverse bend 83 at its lower end which forms an upwardly extending angulated flashing section 85 as viewed in cross-section. The downwardly extending angulated flashing section 82 has a width of about ¾" while the upwardly extending angulated flashing section 85 has a width of about ½", though these particular width dimensions are not intended to restrict the scope of the present invention in any manner. The reverse bend and the angulated flashing sections form double flashing layers that enhance the structural integrity of the external lower end of the exterior flashing section 78 and minimize the potential for damage to the flashing. The reverse bend forms a drip edge that is located well away from the outer surface 30 of the curb wall 22 and well away from an upstanding section of the roof membrane if positioned in the space between the curb wall. The drip edge of the reverse bend 83 causes draining water to fall directly onto the roofing membrane well beyond the curb perimeter that is defined by the curb walls.

With reference now to FIGS. 15-20 of the drawings, the safety rail assembly is shown to be operatively connected with the pivotally mounted hatch and being collapsible during closing movement of the hatch and being actuated by the hatch to its safe position responsive to opening of the hatch. As shown in FIG. 15, a safety hatch mechanism having a collapsible safety rail assembly is shown generally at 360. A curb member 362, similar to curb 24 of FIG. 1, is provided with upper edge and rim flashing 364, similar to that shown at 70 in FIG. 6. Post mounting brackets 366 and 367 are welded or otherwise fixed to the downwardly extending exterior flashing portion 368 of the upper edge and rim flashing 364 as shown in FIG. 6 and provide fixed support for vertical safety rail posts 369 and 370 of a safety rail assembly generally shown at 371. Each of the vertical safety rail posts 369 and 370 is of similar or identical construction as shown in FIGS. 9 and 17, provided with a mounting bolt having a threaded shaft 372 that extends through aligned apertures of a post mounting bracket and receiving a washer 373 and a lock nut 374 for securing the vertical safety rail posts to the brackets. The lock nut is tightened on the threaded shaft of the bolt to mount the vertical post in substantially immoveable relation with its mounting bracket 366.

The upper portion of each vertical safety rail post defines horizontally aligned apertures through which extend the pivot shaft 375 of a pivotally moveable safety rail mounting member shown generally at 376. The mounting member defines a tubular receptacle 377 having an inner cylindrical surface 378 defining an opening 379 through which is moveably extended one end portion of a substantially horizontally oriented pivotally moveable safety rail member 380. The pivot shaft 375 is provided with a threaded extremity 381 that receives a washer member 382 and a lock nut 383, with the lock nut being adjusted to secure the safety rail mounting member 376 in pivotally moveable assembly with the vertical safety rail post 370. A loop member 384 is formed on or fixed to the lock nut member and provides a connection point for a safety chain or cable member as discussed below.

A hatch cover or closure 385 is pivotally mounted to the curb structure 362 and is pivotally moveable to an open position shown in FIG. 15 to permit ingress and egress of workers and materials is moveable and to a closed position covering the upper edge and rim flashing 386 and the upper portion of the downwardly extending exterior flashing portion 387. The hatch or closure 385 may be of the same or similar construction and function shown at 38 in FIG. 1 and other figures of the drawings. Substantially horizontal safety rail members, one being shown at 388, have one end thereof mounted to the hatch cover or closure 385 by a pivot mount shown generally at 390 and presented in detail in FIG. 17. A mounting bolt 391 is welded or otherwise fixed to the hatch cover 385 and extends through aligned apertures of the horizontal safety rail member 388, thus providing pivotal support therefor. A washer 392 and a lock nut 393 are received by the threaded extremity of the mounting bolt 391 to secure the horizontal safety rail member 388 in pivotal assembly with the hatch cover 385.

As shown in FIG. 15 the hatch cover 385 is at its open position and the horizontal safety rail members are oriented substantially horizontally due to the locations of the pivot point of the pivot mount 390 and tubular receptacle 377. As shown in FIG. 16, the hatch cover 385 is shown after having been pivotally moved toward its closed position. During this pivotal hatch closing movement, due to the pivotal connection of the rail 388 with the hatch cover, the rail is pivoted about the pivot shaft 375 and is moved linearly within the opening 379 of the tubular receptacle 377 toward the collapsed or inoperative condition of the safety railing assembly. Obviously, with the hatch cover 385 closed, operative or erected positioning of the safety railing is not needed.

In FIGS. 19 and 20 a further alternative embodiment of the present invention is shown, having like components, as compared with FIGS. 15-17, being indicated by like reference numerals. FIG. 19 is a front elevational view of a safety hatch system, with the hatch cover 385 open. A releasable safety member 394, which may be in the form of a chain, cable, rope, elongate or articulated structure has one end thereof connected with the loop member 384 of one of the safety rail mounting members 376 of the vertical safety rail posts 369 and 370. The opposite end of the releasable safety member 394 is releasably connected with the opposite safety rail mounting member such as by a snap-swivel connector, a quick-link connector or by means of any other suitable releasable connector device. Side safety members 395 and 396, which may be composed of chain material, metal cable material, rope or any other suitable flexible material have one of the ends there connected with connector loops 397 of the posts 369 and 370 and have the other ends thereof mounted to connector loops 398 the hatch cover 385.

As the hatch cover is pivotally moved toward its open position, shown in FIGS. 19 and 20 the side safety members 395 and 396 will be raised to their operative positions by the hatch cover 385, thereby establishing a safe hatch condition, preventing personnel from falling into the hatch opening from the sides of the hatch. For personnel ingress and egress one end of the front releasable safety member 394 must be released from the respective connector loop of the posts 369 or 370. During personnel ingress and egress the loosened releasable safety member 394 also serves as a "grab" member which can be grasped by the personnel to assist in stabilizing the person moving through the safety rail front opening. As the hatch cover is pivotally moved toward its closed position the side safety members 395 and 396 will collapse since they will not be needed for personnel safety when the hatch cover is closed.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A safety hatch and guard rail system for an access opening of a roof of a building, comprising:

a generally rectangular roof hatch curb projecting upwardly from a roof deck at the roof access opening, said generally rectangular roof hatch curb defining an upwardly facing curb rim and inner and outer wall surfaces;

an upper edge and rim flashing covering said upward facing curb rim and defining an exterior flashing section extending downwardly along said outer wall surface of said generally rectangular roof hatch curb;

a plurality of safety rail mounting brackets being fixed to said exterior flashing section and projecting outwardly beyond said exterior flashing section and defining safety rail support post mount holes;

a safety rail assembly having a plurality of safety rail support posts each having a downwardly projecting mounting member being received by a safety rail support post mount hole; and retainer members being received by said safety rail support post mounting members and securing said mounting members to said safety rail mounting brackets and securing said safety rail assembly to said exterior flashing section of said upper edge and rim flashing.

2. The safety hatch system of claim 1, comprising:

said plurality of safety rail brackets each being welded to said exterior flashing section and projecting outwardly therefrom; and said exterior flashing section extending downwardly in spaced relation with the outer wall surface of said rectangular curb and defining a downwardly facing perimeter receptacle adapted for receiving and positioning an upstanding section of a roofing membrane therein.

3. The safety hatch system of claim 1, comprising:

each of said plurality of safety rail support posts defining a connector receptacle;

said support post mounting member being a threaded mounting bolt member projecting from said connector receptacle and engaging one of said plurality of safety rail support brackets; and a said retainer members each being retainer nut members having threaded engagement with said support post mounting bolt members and securing each of said safety rail support posts to said one of said safety rail support brackets.

4. The safety hatch system of claim 1, comprising:

said curb being defined by a front wall, a rear wall and a pair of side walls; and said plurality of safety rail support brackets including a pair of rear brackets extending in substantially normal relation with said side walls of said curb wall and a pair of front brackets extending in acute angular relation with said side walls and projecting forwardly of said front wall.

5. A safety hatch system, comprising:

a generally rectangular curb defining an inner and outer wall surface and a rim surface and having an interior flashing lining said inner wall surface and extending beneath said curb and defining curb mount flashing extending beyond said outer wall surface;

upper edge and rim flashing engaging said rim surface and defining an exterior flashing section extending downwardly along and in substantially parallel relation with said outer wall surface;

a cover mechanism being pivotally mounted to said generally rectangular curb and being movable to an open position permitting personnel access to a roof and a closed position covering said generally rectangular curb and said upper edge and rim flashing;

a plurality of safety rail support brackets projecting outwardly beyond said exterior flashing section and defining safety rail mount holes;

a safety rail assembly having a plurality of safety rail support posts each having a downwardly projecting mounting member being received by said safety rail mount holes and securing said safety rail assembly in immovable assembly therewith, said plurality of safety rail support posts each defining an internal receptacle and having a mounting structure located within said internal receptacle;

each of said plurality of safety rail mounting brackets being of rectangular tubular cross-sectional configuration and having upper and lower mounting holes disposed in substantially vertical registry;

said downwardly projecting mounting member being a threaded bolt member having retained engagement with said mounting structure and extending downwardly through said upper and lower mounting holes; and a retainer member having threaded engagement with said downwardly projecting mounting member and retaining said safety rail support post to said safety rail mounting bracket.

6. The safety hatch system of claim 5, comprising:

said exterior flashing section extending downwardly in spaced relation with said outer wall surface and defining a downwardly facing perimeter receptacle receiving and positioning an upstanding section of roofing membrane therein;

each of said plurality of safety rail support posts defining a connector receptacle;

a post mounting member projecting from said connector receptacle and engaging one of said plurality of safety rail support brackets; and a retainer member engaging said post mounting member and securing said safety rail support post to said safety rail support bracket.

7. The safety hatch system of claim 5, comprising:

said exterior flashing section defining an outwardly and downwardly angulated drip section defining a drip edge located in spaced relation with said outer wall surface of said curb; and said plurality of safety rail mounting brackets being fixed to said exterior flashing section and projecting outwardly therefrom.

8. The safety hatch system of claim 5, comprising:

said plurality of safety rail mounting brackets being welded to said, exterior flashing section and projecting outwardly therefrom.

9. The safety hatch system of claim 7, comprising:

said curb being defined by a front wall, a rear wall and a pair of side walls; and said plurality of safety rail support brackets including a pair of rear brackets extending in substantially normal relation with said side walls of said curb, wall and a pair of front brackets extending angular relation with said side walls and projecting forwardly of said front wall.

10. The safety hatch system of claim 5, comprising:

a plurality of adjustable clamping and positioning members being mounted to said exterior flashing section and having portions thereof for engaging and securing roofing membrane between the flashing and curb, for strengthening the lower drip edge of the flashing and for maintaining desired spacing of the flashing from the curb.

11. The safety hatch system of claim 5, comprising:

a plurality of adjustable clamping and positioning members being mounted to said exterior flashing section and having portions thereof for engaging and securing roofing membrane between said exterior flashing section and said curb, strengthening the exterior flashing section and for maintaining desired spacing of said exterior flashing section with the curb, each of said plurality of adjustable clamping and positioning members having a nut member supported by said exterior flashing section; and a clamping bolt member adjustably engaging said nut member and having a clamping surface disposed for clamping engagement with roofing membrane for securing the roofing membrane between the outer wall surface of the curb and said exterior flashing section.

* * * * *